US012546105B2

(12) United States Patent
Chada

(10) Patent No.: US 12,546,105 B2
(45) Date of Patent: Feb. 10, 2026

(54) FRAMING MEMBER, CONSTRUCTION PANEL, AND METHODS OF MANUFACTURING

(71) Applicant: Venugopal Chada, New Berlin, WI (US)

(72) Inventor: Venugopal Chada, New Berlin, WI (US)

( * ) Notice: Subject to any disclaimer, the term of this patent is extended or adjusted under 35 U.S.C. 154(b) by 174 days.

(21) Appl. No.: 18/396,471

(22) Filed: Dec. 26, 2023

(65) Prior Publication Data

US 2024/0209616 A1 Jun. 27, 2024

Related U.S. Application Data

(60) Provisional application No. 63/477,006, filed on Dec. 23, 2022.

(51) Int. Cl.

| | |
|---|---|
| ***E04B 1/04*** | (2006.01) |
| ***E04B 1/21*** | (2006.01) |
| ***E04B 1/24*** | (2006.01) |
| ***E04B 1/26*** | (2006.01) |
| ***E04B 1/58*** | (2006.01) |
| ***E04B 1/62*** | (2006.01) |

(52) U.S. Cl.

CPC ..... *E04B 1/043* (2013.01); *E04B 1/215* (2013.01); *E04B 1/5812* (2013.01); *E04B 1/62* (2013.01); *E04B 2001/2445* (2013.01); *E04B 2001/2644* (2013.01)

(58) Field of Classification Search

CPC ..... E04B 1/043; E04B 1/215; E04B 1/5812; E04B 1/62; E04B 2001/2445; E04B 2001/2644

See application file for complete search history.

(56) References Cited

U.S. PATENT DOCUMENTS

| | | | | |
|---|---|---|---|---|
| 8,312,683 | B2 | 11/2012 | Tadros et al. | |
| 8,516,762 | B1 | 8/2013 | Jendusa | |
| 9,518,401 | B2 * | 12/2016 | Wang | E04B 5/29 |

(Continued)

FOREIGN PATENT DOCUMENTS

| | | | |
|---|---|---|---|
| KR | 10-2013-0043324 | A | 4/2013 |
| KR | 10-1875749 | B1 | 7/2018 |
| KR | 10-2019-0115814 | A | 10/2019 |

OTHER PUBLICATIONS

"International Search Report and Written Opinion received for PCT Patent Application No. PCT/US2023/085940, mailed on May 7, 2024", 10 pages.

*Primary Examiner* — Rodney Mintz
(74) *Attorney, Agent, or Firm* — Maschoff Brennan

(57) ABSTRACT

A construction panel includes a concrete layer and a plurality of framing members coupled to the concrete layer. Each framing member includes first and second channels having respective webs and flanges extending from the webs to form openings in first and second channels facing away from each other. Each framing member also includes a plurality of flanges positioned in and extending across a gap between the first and second channels. Each framing member further includes at least one bent bar including a first plurality of bar sections, with each bar section of the first plurality of bar sections positioned adjacent to at least one flange of the plurality of flanges and extending out from within the gap and into the concrete layer.

26 Claims, 26 Drawing Sheets

(56) References Cited

U.S. PATENT DOCUMENTS

| | | | | |
|---|---|---|---|---|
| 9,909,308 | B2 * | 3/2018 | Kwon | E04C 5/065 |
| 11,761,193 | B2 * | 9/2023 | Soivio | E04C 3/07 52/649.2 |
| 2008/0028719 | A1 | 2/2008 | Rutledge | |
| 2009/0205285 | A1 * | 8/2009 | Jendusa | E04B 5/263 52/741.1 |
| 2011/0061329 | A1 * | 3/2011 | Tadros | E04C 2/044 52/794.1 |
| 2015/0167289 | A1 * | 6/2015 | Wang | E04H 1/04 52/745.19 |
| 2018/0002925 | A1 | 1/2018 | Kwon | |
| 2022/0025636 | A1 * | 1/2022 | Soivio | E04C 3/07 |

* cited by examiner

FRAMING MEMBER, CONSTRUCTION PANEL, AND METHODS OF MANUFACTURING

CROSS-REFERENCE TO RELATED APPLICATIONS

The present application is a non-provisional of and claims priority to U.S. Provisional Patent Application Ser. No. 63/477,006, filed Dec. 23, 2022, the disclosure of which is incorporated herein by reference in its entirety.

BACKGROUND OF THE INVENTION

Embodiments of the present invention relate to framing members and, more particularly, to framing members for use in construction panels.

Construction companies or builders may erect structures using many different types of construction systems or panels for use as floor and wall systems or panels. Such systems and panels may incorporate a variety of different materials including, but not limited to, wood, plastic, insulation, metal, and/or concrete. Builders or manufacturers may utilize these materials in various combinations in constructing floor and wall systems or panels, but the goal is always the same. That is, they are attempting to create systems or panels that are acceptable for use in erecting a structure. However, all of the existing floor and wall systems or panels have drawbacks.

One type of flooring system is a steel joist and deck system. A steel joist and deck system includes steel beams or trusses with corrugated steel decking secured to the top. This system is commonly used to support a concrete floor. While this system is common, it has high installation costs and lengthy erection times associated with it. Further, pouring concrete for this system often involves unsafe construction site conditions with high liability costs. Additionally, in comparison to precast methods, this system requires more labor and has an inferior quality.

Light gauge steel composite systems may also be used for flooring. These systems include steel joists and removable plywood formwork with a layer of concrete poured on top. Builders embed a deformed flange along the top of the joists into the concrete to provide a composite structure. The installation of such systems is cumbersome, time consuming, and labor intensive due to the need for steel reinforcing, the time for the concrete to cure, and the removal of the plywood formwork. Further, builders must attach furring to the joists for drywall installation, which adds more cost and time to the overall installation.

Foam form decks use reinforced expanded polystyrene (EPS) as a forming system for reinforced concrete floors. Such a system typically requires shoring and complicated engineering and detailing for the design of the reinforced concrete. As a result, this type of flooring system only allows for limited floor spans and implements a costly and labor intensive installation. In addition, the system does not allow for wall finishes, and the quality of the system is commonly reduced by air pockets that are difficult to avoid in the concrete.

In a precast concrete floor plank system, builders set manufactured prestressed concrete planks in place with a crane and place concrete on the surface. The overall installation cost and time are high and lengthy, respectively, due to a high upfront cost for precast concrete and the weight of the concrete planks. The heavy concrete planks require a costly structure to support them and a large, expensive crane to move them. The need to attach furring to the joists prior to drywalling also increases installation cost and time. Furthermore, installing ductwork, conduits, and piping involves drilling into dense concrete, and the close spacing of the prestressed strands limits penetrations through the floor.

For poured in place concrete floors, builders use a construction method including erecting formwork, installing reinforcing or post-tensioning steel, and pouring concrete. Once the concrete has cured, the builders remove the formwork before moving up to the next level. This construction method is time consuming and expensive and involves on-site post-tensioning, which is a relatively dangerous task that must be performed by highly skilled workers. Also, builders using this method must attached of furring to the concrete for drywall installation and drill into the concrete for ductwork, conduit, and piping installation. Moreover, this method limits penetrations through the floor due to the close spacing of the reinforcing or post-tensioning steel.

As to wall systems or panels, one type of wall panel is an architectural precast concrete or cladding panel. Manufacturers precolor and prefinish precast concrete wall panels, and builders use them in curtain wall systems on larger commercial projects. These panels are heavy because they have a solid construction, with a typical thickness of 6 inches (15.24 centimeters). They then transport the panels to the project site for installation with cranes, with the exposed concrete becoming the exterior surface of the wall. These panels are costly and do not include much insulation.

In insulated concrete form (ICF) walls, builders pour concrete between two sheets of foam insulation or foam forms at the project site. The foam forms have built-in furring for installing drywall on the interior and siding on the exterior. Builders use ICF walls below and above grade with floor and roof structures typically bearing on the walls. The construction of these walls is costly, difficult, and time consuming. The task of installing and bracing the walls is labor intensive and requires specialized equipment. In addition, installation of electrical and plumbing along the inside of the walls is difficult and unfamiliar to many builders.

Another option for wall panels is precast concrete wall panels. Manufacturers construct these panels off site, and builders set them in place using a crane. Floor and roof structures typically bear on these panels. Builders use precast concrete panels extensively as walls for single story buildings, warehouses, and big box retail buildings. The panels are high in cost and weight and low in insulation. Additionally, the interior concrete surfaces of the panels require furring for drywall installation.

During the construction of tilt-up concrete wall panels, builders install formwork and reinforcing on a building concrete slab on grade and pour concrete in the formwork. The builders then tilt the concrete panels up and set them in place using a crane, with floor and roof structures typically bearing on the panels. Like precast concrete wall panels, builders often use tilt-up concrete wall panels in single story buildings, warehouses, and big box retail buildings. However, these panels are costly, time consuming to construct, and limited for use according weather interference. Further, the panels have minimal insulation, limited exterior surfaces that need finishing, and interior surfaces that need furring for drywall installation.

It would therefore be desirable to provide a construction system or panel that may be used for construction of floors and walls and that has a lower cost to manufacture and install, lighter weight, quicker installation, and higher thermal efficiency.

BRIEF STATEMENT OF THE INVENTION

In accordance with one aspect of the invention, a framing member for construction panels includes first and second channels. The first channel includes a web and first and second flanges extending from the web in a first direction to form an opening. The second channel includes a web spaced apart from the web of the first channel to form an internal area between the webs of the first and second channels and first and second flanges extending from the web in a second direction to form an opening facing away from the opening in the first channel. The framing member also includes a plurality of flanges positioned in and extending across the internal area. In addition, the framing member includes a first bent bar having a first plurality of bar sections, each bar section of the first plurality of bar sections extending from within the internal area to an external area beyond the first flanges of the first and second channels and positioned adjacent to at least one flange of the plurality of flanges in the internal area. Further, the framing member includes a plurality of fasteners coupling the first channel to the second channel.

In accordance with another aspect of the invention, a construction panel includes a concrete layer and a plurality of framing members coupled to the concrete layer. Each framing member of the plurality of framing members includes a first channel and a second channel. The first channel includes a web and first and second flanges extending from the web in a first direction to form an opening. The second channel includes a web spaced apart from the web of the first channel to form a gap between the webs of the first and second channels and first and second flanges extending from the web in a second direction to form an opening facing away from the opening in the first channel. Each framing member additionally includes a plurality of flanges positioned in and extending across the gap. Each framing member further includes first bent bar having a first plurality of bar sections, each bar section of the first plurality of bar sections positioned adjacent to at least one flange of the plurality of flanges in the gap and extending out from within the gap and into the concrete layer. In addition, the first bent bar includes a first plurality of bends positioned within the gap and connecting adjacent bar sections of the first plurality of bar sections and a second plurality of bends positioned in the concrete layer and coupling adjacent bar sections of the first plurality of bar sections. Furthermore, each framing member includes a plurality of fasteners coupling the first channel to the second channel.

In accordance with yet another aspect of the invention, a method of manufacturing a construction panel includes providing or assembling a plurality of framing members. Each framing member includes first and second channels. The first channel includes a web and first and second flanges extending from the web in a first direction to form an opening. The second channel includes a web spaced apart from the web of the first channel to form a gap between the webs of the first and second channels and first and second flanges extending from the web in a second direction to form an opening facing away from the opening in the first channel. Each framing member additionally includes a plurality of flanges positioned in and extending across the gap. Furthermore, each framing member includes a bent bar with a plurality of bar sections, each bar section of the plurality of bar sections positioned adjacent to at least one flange of the plurality of flanges in the gap and extending from respective positions inside the gap to respective positions outside the gap beyond the first flanges of the first and second channels. The bent bar also includes a first plurality of bends positioned within the gap and connecting adjacent bar sections of the plurality of bar sections and a second plurality of bends positioned outside of the gap beyond the first flanges of the first and second channels and coupling adjacent bar sections of the plurality of bar sections. Each framing member further includes a plurality of fasteners coupling the first channel to the second channel. The method further includes pouring a concrete layer and coupling each framing member of the plurality of framing members to the concrete layer by inserting into the concrete layer each bend of the second plurality of bends of the bent bar and at least a portion of each bar section of the plurality of bar sections of the bent bar partially extending outside of the gap and allowing the concrete layer to cure.

These and various other features and advantages of the present invention will be more readily understood from the following detailed description and the accompanying drawings.

BRIEF DESCRIPTION OF THE DRAWINGS

The drawings illustrate embodiments presently contemplated for carrying out the invention.

In the drawings.

DETAILED DESCRIPTION

Embodiments of the present invention provide for a framing member, a construction panel that incorporates the framing member, and methods of manufacturing the framing member and construction panel. The framing member includes two channels each having a web and two flanges extending from the web to form an opening. The openings of the two channels are facing away from each other in opposite directions, and the webs of the two channels are spaced apart by a gap therebetween. The framing members also include a plurality of flanges positioned in and extending across the gap between the two channels. The plurality of flanges may be in the form of bendable punch tabs in the webs of the two channels or included in a plurality of channel connectors each having at least one bent plate positioned within the gap between the channel webs and coupling the two channels together. The framing member further includes at least one bent bar having a plurality of bar sections extending from respective positions inside the gap between the channels and to respective positions outside the gap, a plurality of first bends coupling adjacent bar sections inside the gap, and a plurality of second bends coupling adjacent bar sections outside the gap. The construction panel includes a plurality of the above-described framing members coupled to a concrete layer by way of the components of the bent bar positioned outside the gap between the channels being embedded in the concrete layer.

Herein, the term framing member is used as a generic term to refer to both wall studs and floor joists. However, the term framing member may also be used to refer to other framing components including, but limited to, beams, girders, rafters, and planks, in various contexts. In addition, the term construction panel is used herein as a generic term to refer to both wall and floor panels, but should not be construed as limited to wall and floor panels unless otherwise indicated. As a non-limiting example, in some circumstances, the term construction panel may refer to a roof panel.

Figure 1:
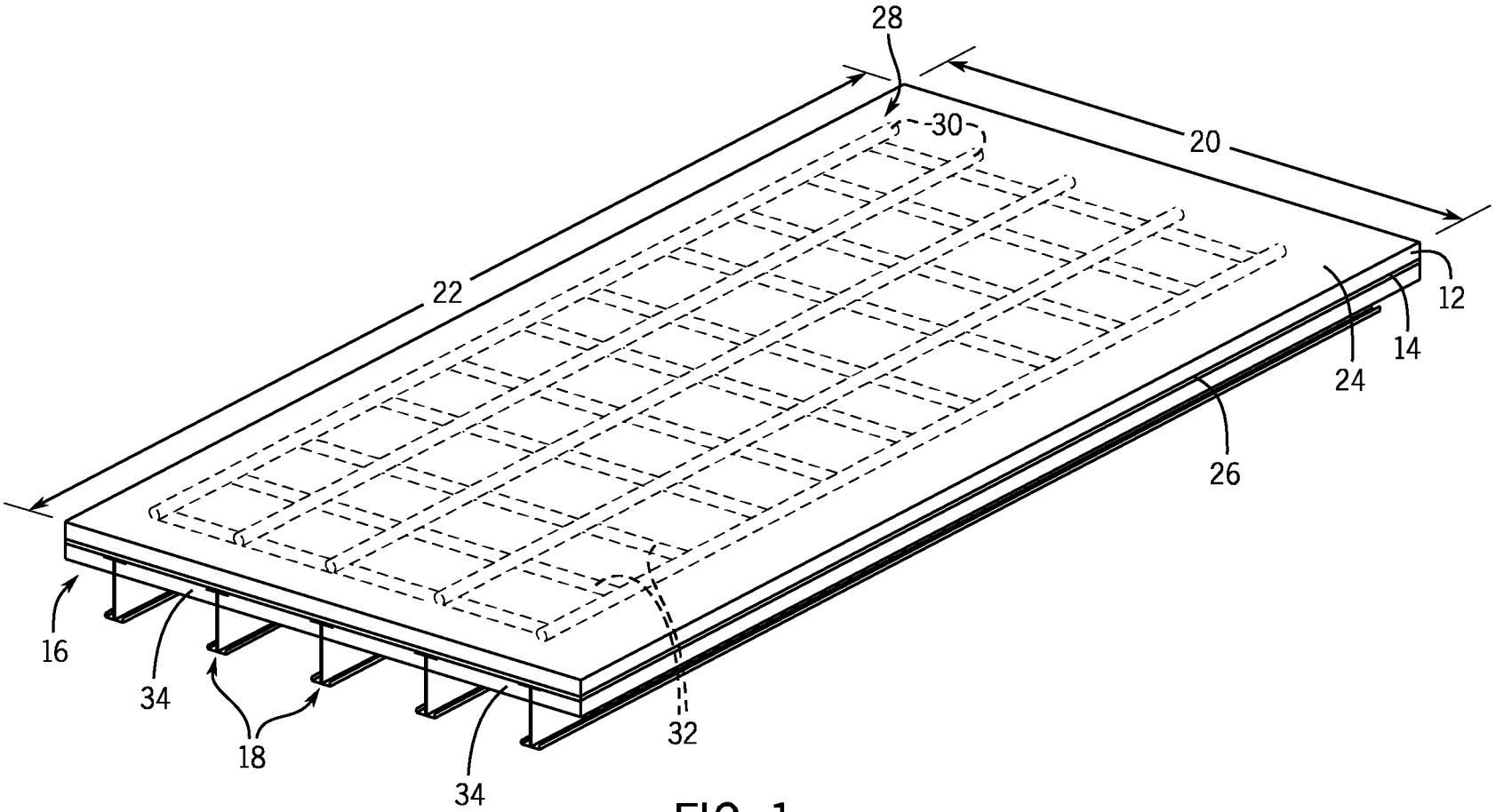
FIGS. 1 and 2 are top and bottom perspective views, respectively, of a construction panel in the form of a floor panel, according to an embodiment of the invention.
Figure 2:
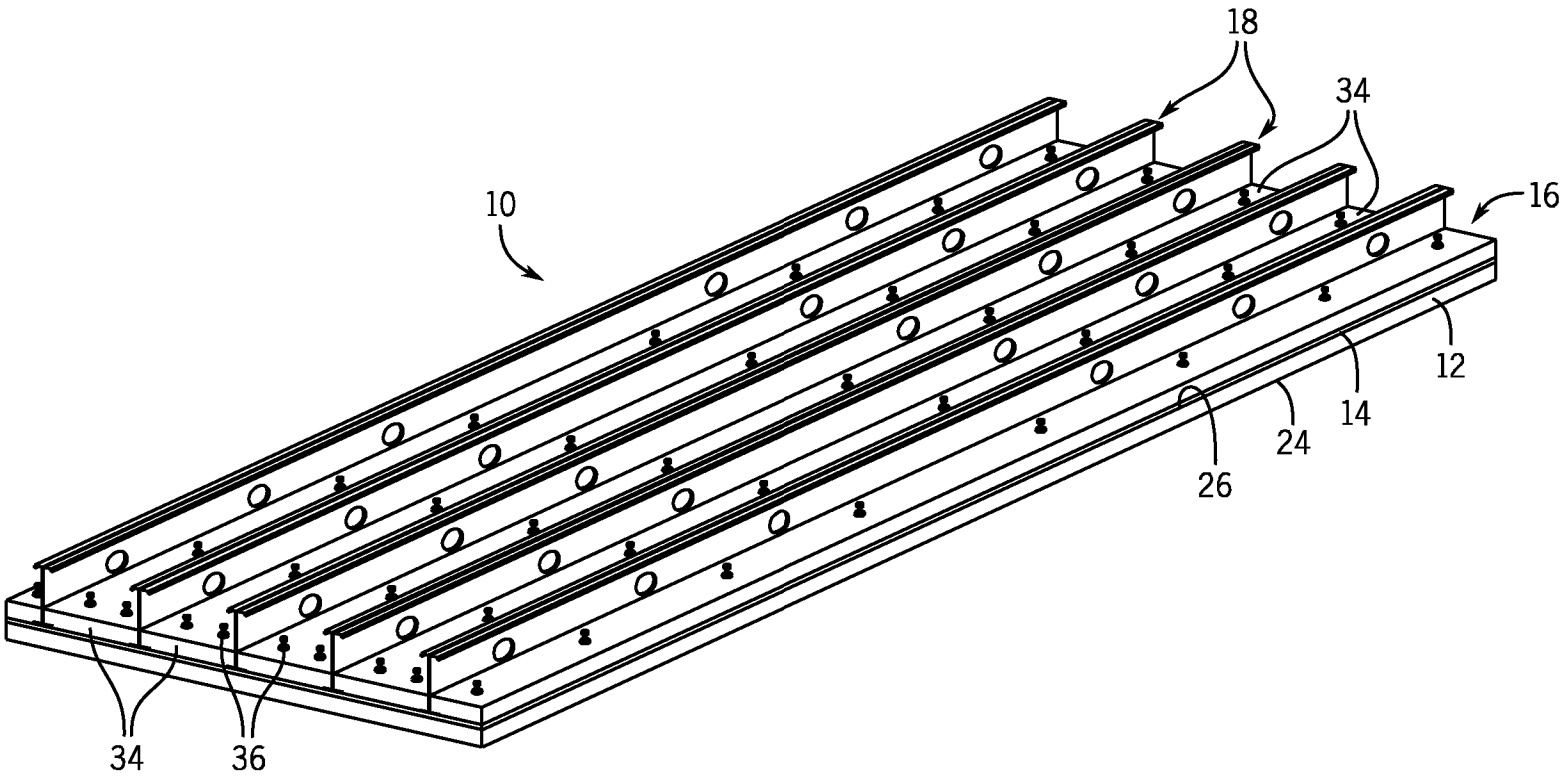

Referring to FIGS. 1 and 2, top and bottom perspective view of a construction panel 10 are shown, according to an embodiment of the invention. In the embodiment of FIGS. 1 and 2, construction panel 10 is arranged as a floor panel. Floor panel 10 includes a concrete layer or wythe 12, a first insulation layer 14, a second insulation layer 16, and a plurality of framing members or joists 18. As shown in FIG. 1, concrete layer 12 has a width 20, a length 22, a top surface 24, and a bottom surface 26. In various embodiments, concrete layer 12 also includes a reinforcing bar or rebar grid or cage 28 positioned between top and bottom surfaces 24, 26 to increase the tensile strength of concrete layer 12. However, rebar grid 28 may not always be necessary such as, for example, where floor panel 10 will not be used for structural purposes. Regardless of whether rebar grid 28 is included in concrete layer 12, concrete layer 12 may also include in-floor radiant heating (not shown).

Rebar grid 28 includes a plurality of lengthwise rebars 30 and a plurality of widthwise rebars 32. While FIG. 1 shows rebar grid 28 with a specific number of lengthwise and widthwise rebars 30, 32 having a substantially cylindrical shape, this configuration of rebar grid 28 is non-limiting. For example, rebar grid 28 may include more or less lengthwise and/or widthwise rebars 30, 32, rebars extending in different directions, rebars in different locations, rebars having different shapes, rebars having different shapes, or various combinations of the above. The configuration of rebar grid 28 will depend on the goals for construction.

During manufacture or casting of floor panel 10, rebar grid 28 may be positioned in formwork prior to pouring concrete layer 12 using supports or chairs (not shown) to position rebar grid 28 at the right height above the ground or floor. The supports may be made of metal, plastic, or other non-corrosive materials. For example, the supports may be in the form of dobies (not shown), which are small concrete blocks. Alternatively, at least a portion of rebar grid 28 may be pushed down into concrete layer 12 from above. In some embodiments, widthwise rebars 32 may be pushed into concrete layer 12 in connection with joists 18, as described in more detail below.

As most clearly shown in FIG. 2, first insulation layer 14 is positioned over or across concrete layer 12 between concrete layer 12 and second insulation layer 16. That is, first insulation layer 14 covers the entirely of bottom surface 26 of concrete layer 12. However, in various embodiments, first insulation layer 14 may cover one or more sections of bottom surface 26 of concrete layer 12. As a non-limiting example, first insulation layer 14 may cover bottom surface 26 of concrete layer 12 where joists 18 are positioned in floor panel 10. In addition, in various embodiments, insulation layer 14 may be omitted from floor panel 10 in order to save on cost. In embodiments where first insulation layer 14 is omitted from floor panel 10, an air gap (not shown) may be present between joists 18 and concrete layer 12. Alternatively, where floor panel 10 does not require a high thermal efficiency, joists 18 may be positioned directly on concrete layer 12.

Second insulation layer 16 is typically positioned over or across first insulation layer 14 and against joists 18. In embodiments where first insulation layer 14 is omitted from floor panel 10, second insulation layer 16 may be positioned either only against joists 18 or against joists 18 and over or across concrete layer 12, depending on whether an air gap is present between joists 18 and concrete layer 12. Second insulation layer 16 includes a plurality of insulation sections 34 positioned on each side of joists 18. First insulation layer 14 is much thinner than second insulation layer 16. As a non-limiting example, first insulation layer 14 may be ¼ inch (0.635 centimeters) or ½ inch (1.27 centimeters) thick and second insulation layer 16 may be at least 3 inches (7.62 centimeters) thick. However, insulation layer 16 may be even thicker than depicted in FIGS. 1 and 2, depending on the clearance allowed by joists 18, the need for additional insulation, and the need to install mechanical, electrical, or plumbing components in floor panel 10.

The insulation for first and second insulation layers 14, 16 may be in any form suitable for use in a construction panel such as, for example, rigid foam board insulation, which is shown as a non-limiting example in FIGS. 1 and 2, or spray foam insulation. Rigid foam board insulation may provide greater sound attenuation than other insulations. Where the insulation is rigid foam board insulation, spray foam insulation may be used to seal gaps, such as, for example, between the rigid foam board insulation and the framing members. In some embodiments, the rigid foam board will include a radiant barrier sheet (not shown) attached thereto to provide additional strength to the rigid foam board insulation. Also, as shown in FIG. 2, pins or connectors 36 may be used to couple insulation layers 14, 16 to concrete layer 12 by inserting them through insulation layers 14, 16 and into concrete layer 12 and allowing concrete layer 12 to cure. Connectors 36 are typically made of plastic to reduce heat transfer, but may be made of other materials, such as, for example, metal, when desired or necessary. The number, shape, and size of connectors 36 shown are merely exemplary and will vary based on need.

Joists 18 may be placed according to any desired spacing such as, for example, 2 feet (60.96 centimeters) on center. The spacing between joists 18 may be selected based on the structural and architectural requirements of construction panel 10. The design of joists 18 allows floor panel 10 to provide many benefits over existing systems. This design will be described below with respect to FIGS. 3-11.

Figure 3:
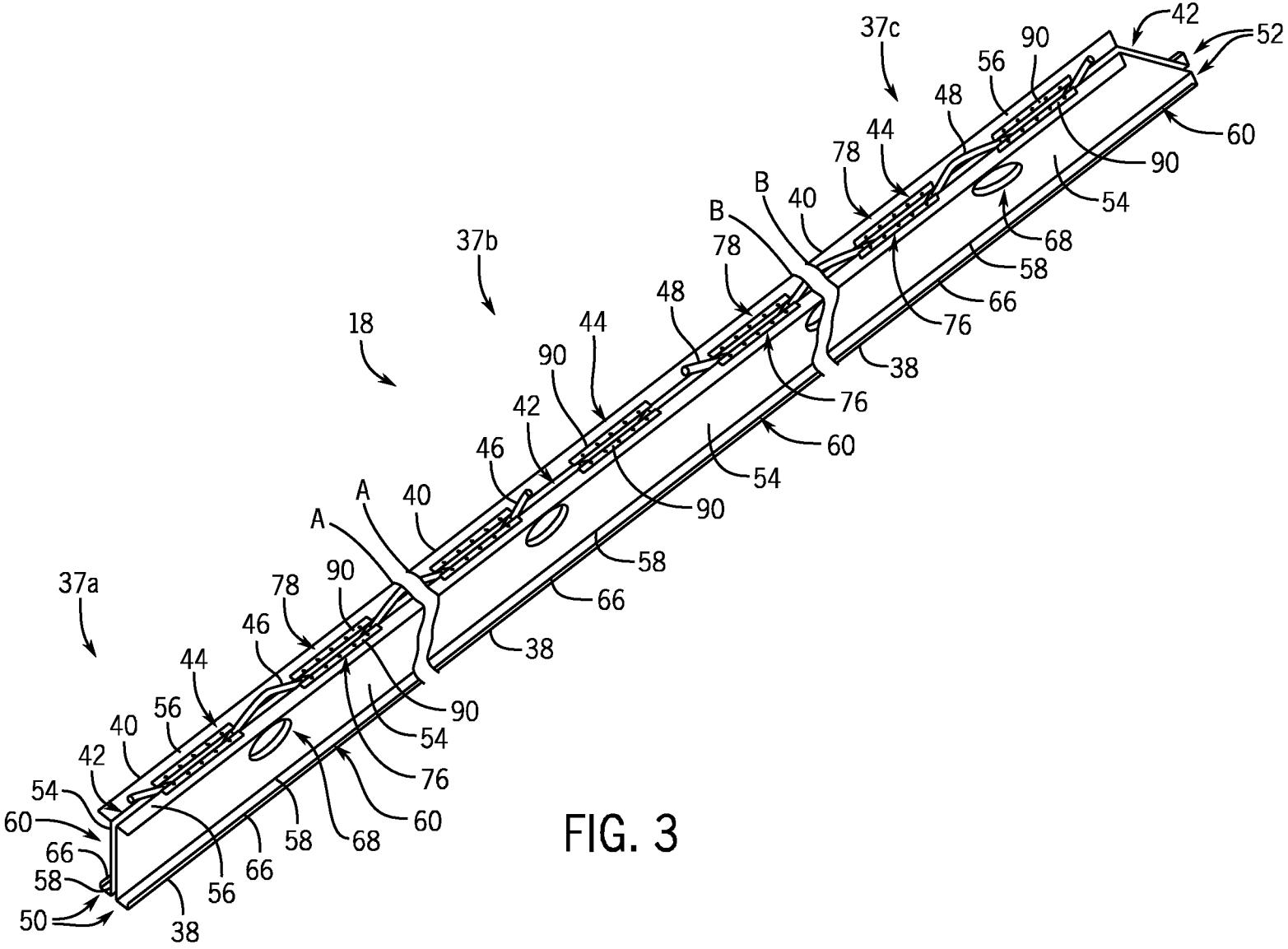
FIG. 3 is a bottom perspective view of a framing member or joist in the floor panel of FIGS. 1 and 2, according to an embodiment of the invention.
Figure 4:
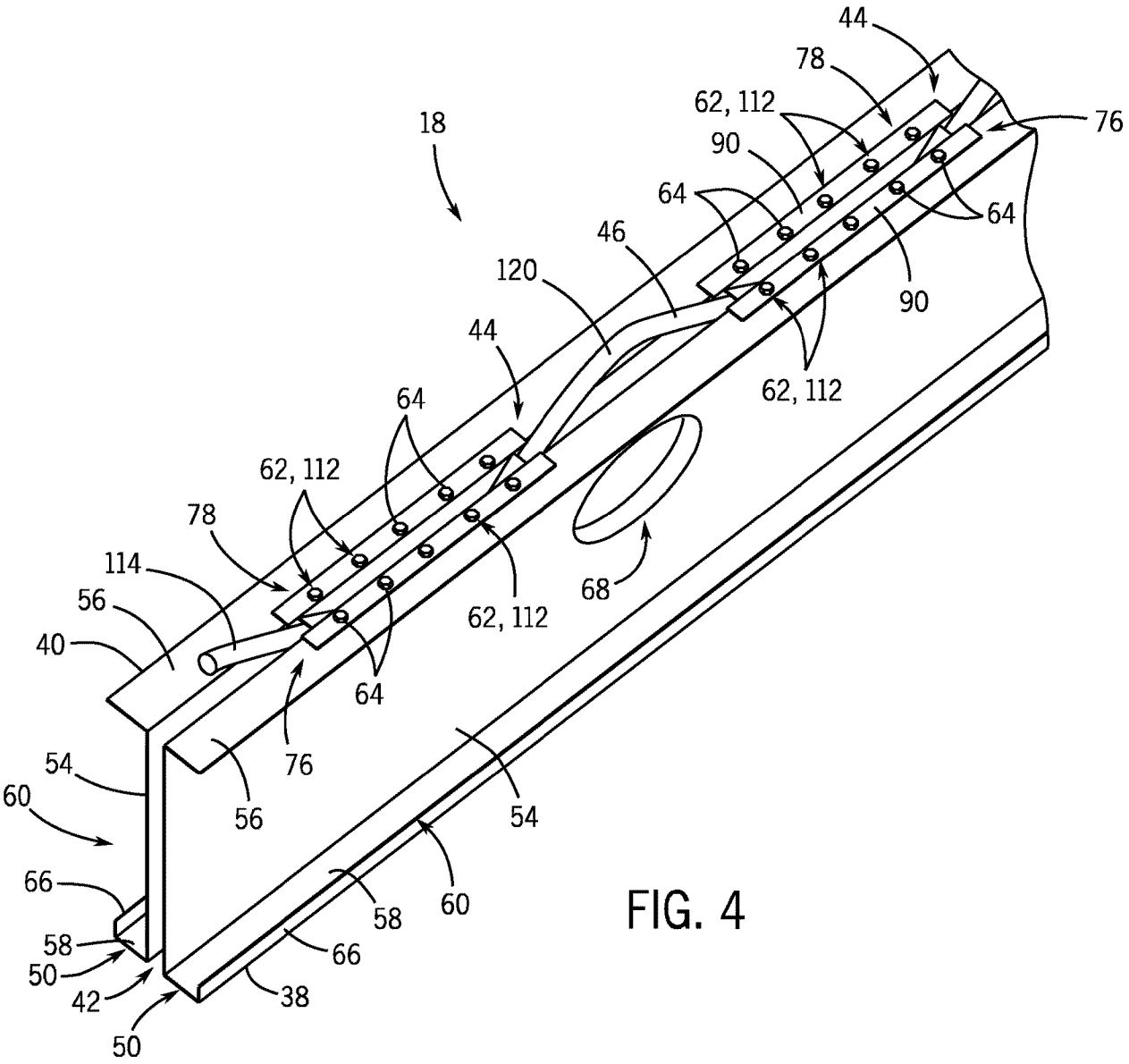
FIGS. 4 and 5 are bottom perspective and side views, respectively, of an end of the joist of FIG. 3, according to an embodiment of the invention.
Figure 5:
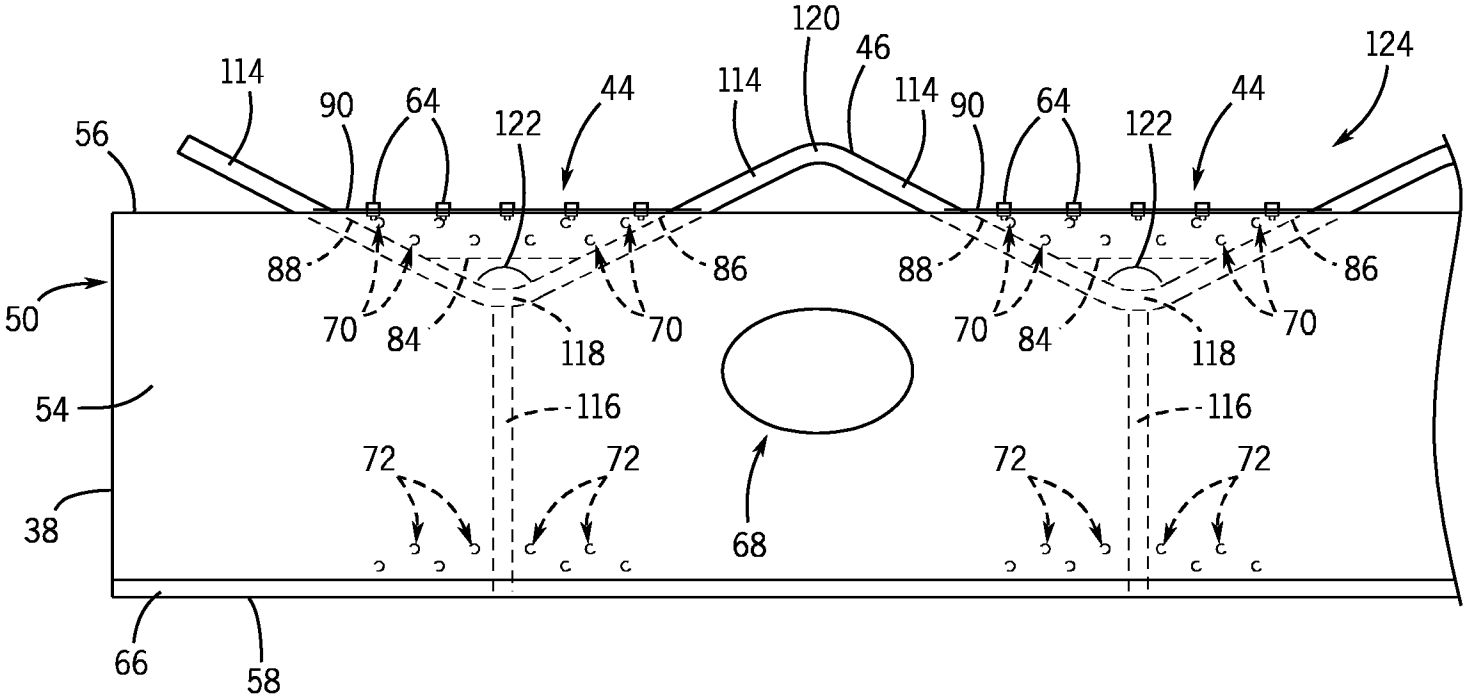

Referring now to FIG. 3-5, a bottom perspective view of one framing member or joist 18 used in floor panel 10 of FIGS. 1 and 2 is shown in FIG. 3, according to an embodiment of the invention, and a bottom perspective view and a side view, respectively, of an end of joist 18 of FIG. 3 are shown if FIGS. 4 and 5, according to an embodiment of the invention. While only one joist 18 from floor panel 10 is shown and described, each joist 18 in floor panel 10 is generally formed in the same manner with the same configuration. However, in various embodiments, joists 18 in floor panel 10 may have different configurations. The arrangement of each joist 18 in one floor panel 10 may depend on various factors such as, for example, the specific use for floor panel 10 and cost considerations.

Joist 18 is shown in FIG. 3 as a first end section 37*a*, a central section 37*b*, and a second end section 37*c*. First end section 37*a* and central section 37*b* are separated by break lines A to show a variable length. Second end section 37*c* and central section 37*b* are separated by break lines B to show a variable length. That is, central section 37*b* is a continuation of first end section 37*a*, and second end section 37*c* is a continuation of central section 37*b* (while second end section 37*c* is shown at different angle from first end section 37*a* and central section 37*b*, this is only to show relevant components of joist 18 in second end section 37*c*). Hence, while joists 18 are shown in FIGS. 1 and 2 as having a particular length, joists 18 may be any length that is structurally sound for a particular construction project.

Joist 18 includes first and second channels 38, 40 spaced apart from one another to form a gap or internal area 42 therebetween, a plurality of channel connectors 44, and first and second bent bars 46, 48. Channels 38, 40 may be made of any type of steel roll forming manufacturing machinery that produces standard shapes and sizes per the American Iron Steel Institute or AISI. As non-limiting examples, channels 38, 40 may be formed out of cold-formed steel or structural steel. However, between cold-formed steel and structural steel, cold-formed steel is often preferred as being the lighter material of the two. Typically, but not necessarily, channels 38, 40 will have a strength from 33 to 80 kilopounds per square inch (KSI) (227.5 to 551.6 megapascals (MPA)) Channels 38, 40 typically have the same shape and configuration, but may have different shapes and/or configurations from each other under various circumstances such as, for example, where a shortage of materials affects what is available to use in floor panel 10.

As shown in FIG. 3, each channel 38, 40 includes a first end 50, a second end 52, a web 54, a first or bottom flange 56, and a second or top flange 58. First and second flanges 56, 58 extend from web 54 to form openings 60 in channels 38, 40. Openings 60 in channels 38, 40 face away from each other in opposite directions. As shown most clearly in FIG. 4, first flanges 56 of each channel 38, 40 include fastener openings 62 for fasteners 64 to couple first flanges 56 of each channel to channel connector 44, as described in more detail below. In various embodiments, second flanges 58 may also include fastener openings 62 as duplicate fastener openings such that the orientation of channels 38, 40 is irrelevant during assembly of joist 18.

First flange 56 is flat and extends perpendicularly from web 54 to form an ⌋ shape with web 54. This configuration allows insulation, especially rigid foam board insulation, to more easily slide and fit into openings 60 in channels 38, 40. Like first flange 56, second flange 58 extends perpendicularly from web 54, but also includes a lip 66 extending therefrom to form an approximate ⌋ shape with web 54. However, each of first and second flanges 56, 58 may have different shapes and extend at different angles, as desired. As a non-limiting example, first flange 56 may include a lip (not shown) like second flange 58 under various circumstances, such as, for example, where it may be desirable to hook the insulation thereon or provide more surface area to which insulation may attach. Further, second flange 58 may be flat to form an ⌋ shape with web 54 like first flange 56 such that each channel 38, 40 has a ⌋ shape.

Web 54 of each channel 38, 40 includes a plurality of openings 68 therein for mechanical, electrical, and plumbing installations. FIGS. 4 and 5 show a closer view of one such opening 68. However, openings 68 may be omitted where unnecessary or where a builder desires to cut out openings 68 on an as needed basis. Further, openings 68 may be different in number from that shown, depending on the requirements for a particular use of floor panel 10. In addition, openings 68 may be smaller, larger, or a different shape based on considerations such as, for example, their intended use for utilitarian or aesthetic purposes. Builders may also increase the size or change the shape of openings 68 on a job site when desired.

As shown most clearly in FIG. 5, webs 54 of each channel 38, 40 (while only channel 38 is shown in FIG. 5, webs 54 of channels 38, 40 have the same configuration) may include a plurality of optional first fastener openings 70 near first flanges 56 and a plurality of optional second fastener openings 72 near second flanges 58. Fasteners 64 may be used in conjunction with first fastener openings 70 to couple webs 54 of channels 38, 40 to channel connectors 44 in addition to or instead of being used in conjunction with fastener openings 62 in first flanges 56 of channels 38, 40. When possible, fastener openings 70, 72 are generally positioned close to flanges 56, 58, respectively, of channels 38, 40 to avoid excessively weakening channels 38, 40. In various embodiments, second fastener openings 72 may be used to couple channels 38, 40 to channel connectors 44 instead of first fastener openings 70. That is, first and second fastener openings 70, 72 may be provided as duplicate fastener openings in a similar manner to how second flanges 58 of channels 38, 40 may have fastener openings 62 in addition to fastener openings 62 in first flanges 56 of channels 38, 40, as explained above. Alternatively, fasteners 64 may be used to connect webs 54 of channels 38, 40 directly.

When fasteners 64 are positioned in fastener openings 62, fastener openings 70, 72 are considered optional because fasteners 64 in fastener openings 62 are generally considered sufficient to couple channels 38, 40 to channel connectors 44. Thus, while adding fasteners 64 in fastener openings 70, 72 may provide additional structural support in coupling channels 38, 40 to connectors 44, they would be duplicative to those in fastener openings 62. Further, installing fasteners 64 in fastener openings 62 is preferred because installing fasteners 64 in fastener openings 70, 72 is more labor intensive. That is, installing fasteners 64 in fastener openings 62 from above channels 38, 40 is easier than installing fasteners 64 in fastener openings 70, 72 from the side of channels 38, 40.

Figure 6:
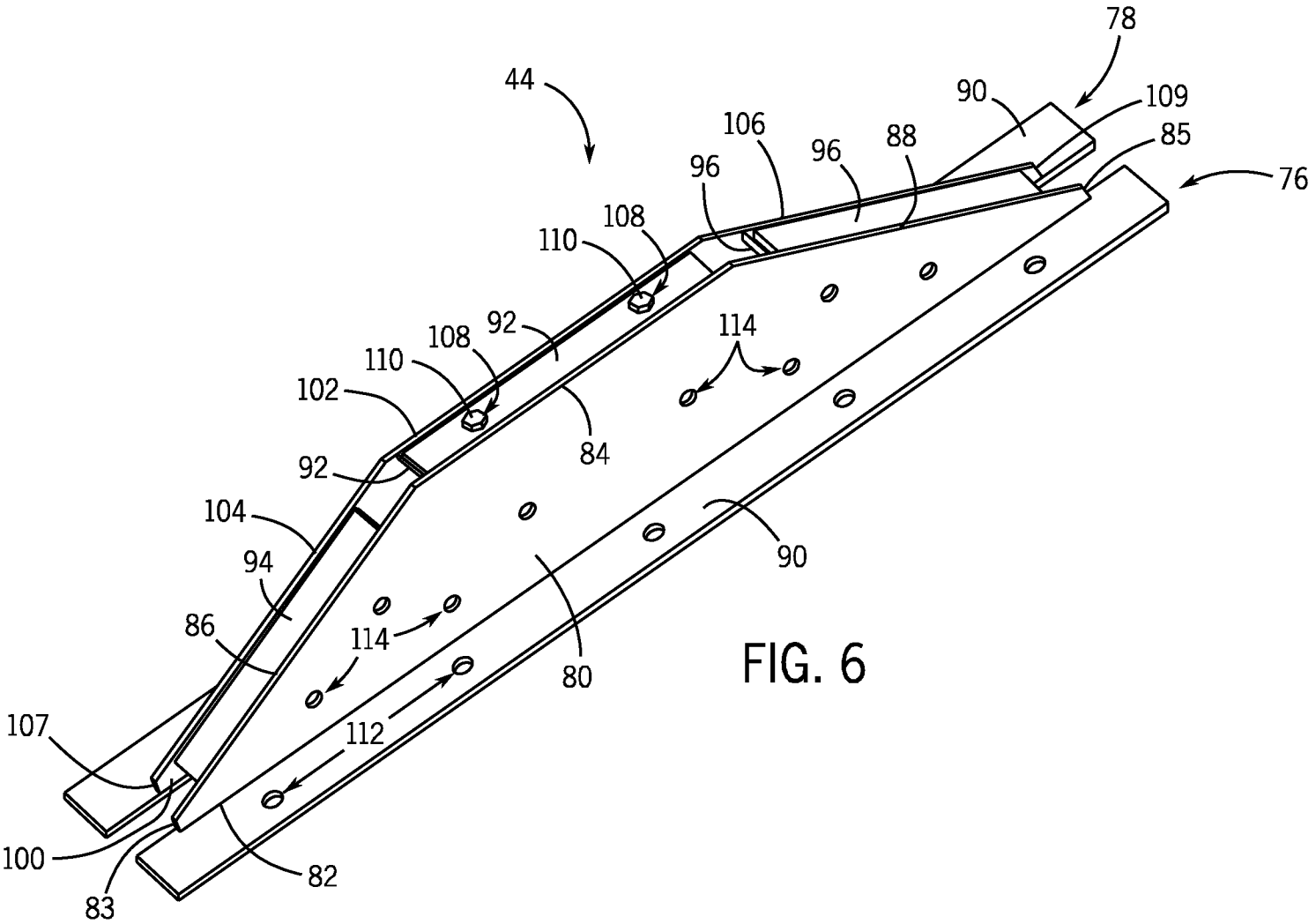
FIG. 6 is a top perspective view of a channel connector of the joist of FIG. 3, according to an embodiment of the invention.
Figure 7:
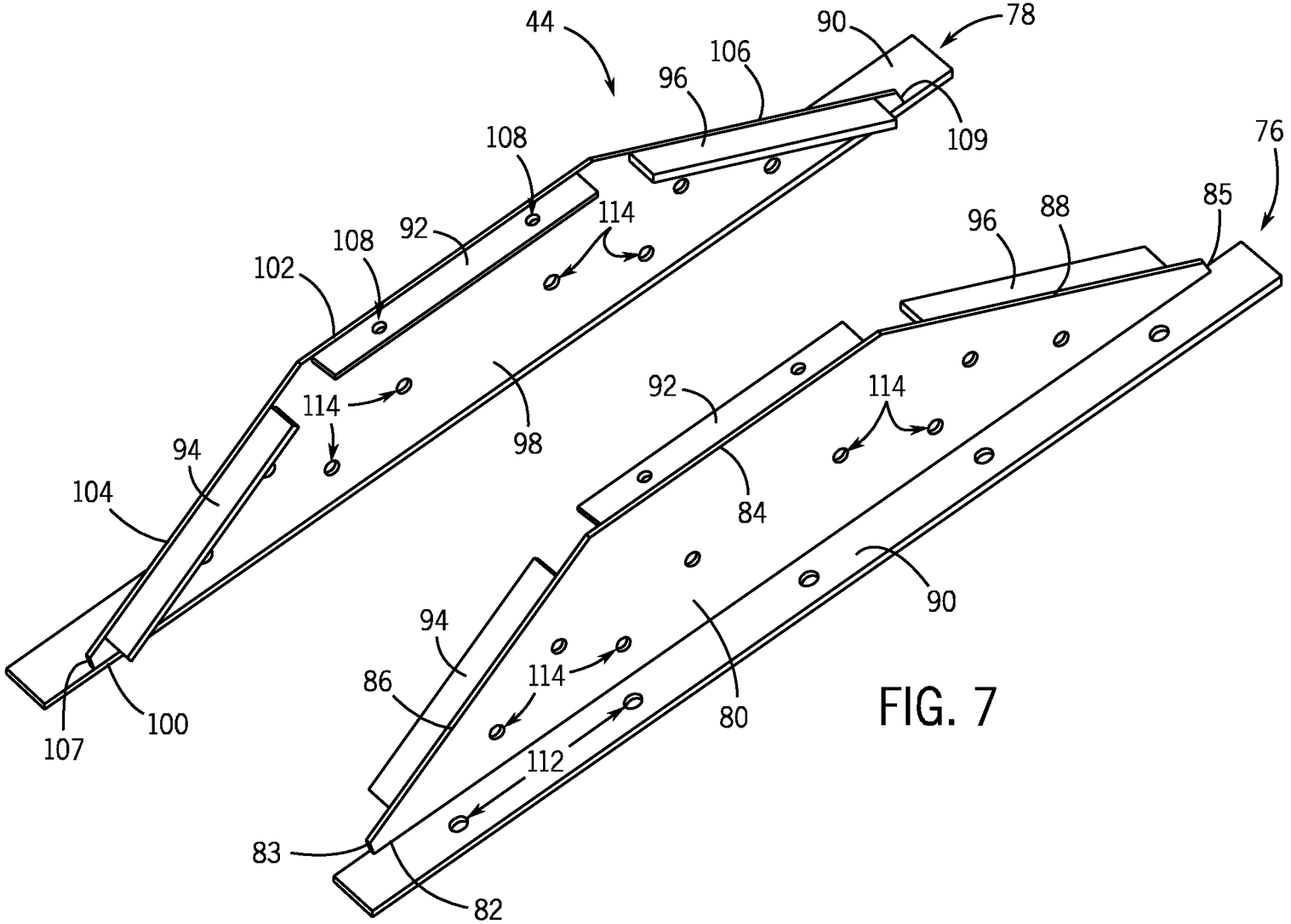
FIG. 7 is an exploded view of the channel connector of FIG. 6, according to an embodiment of the invention.
Figure 8:
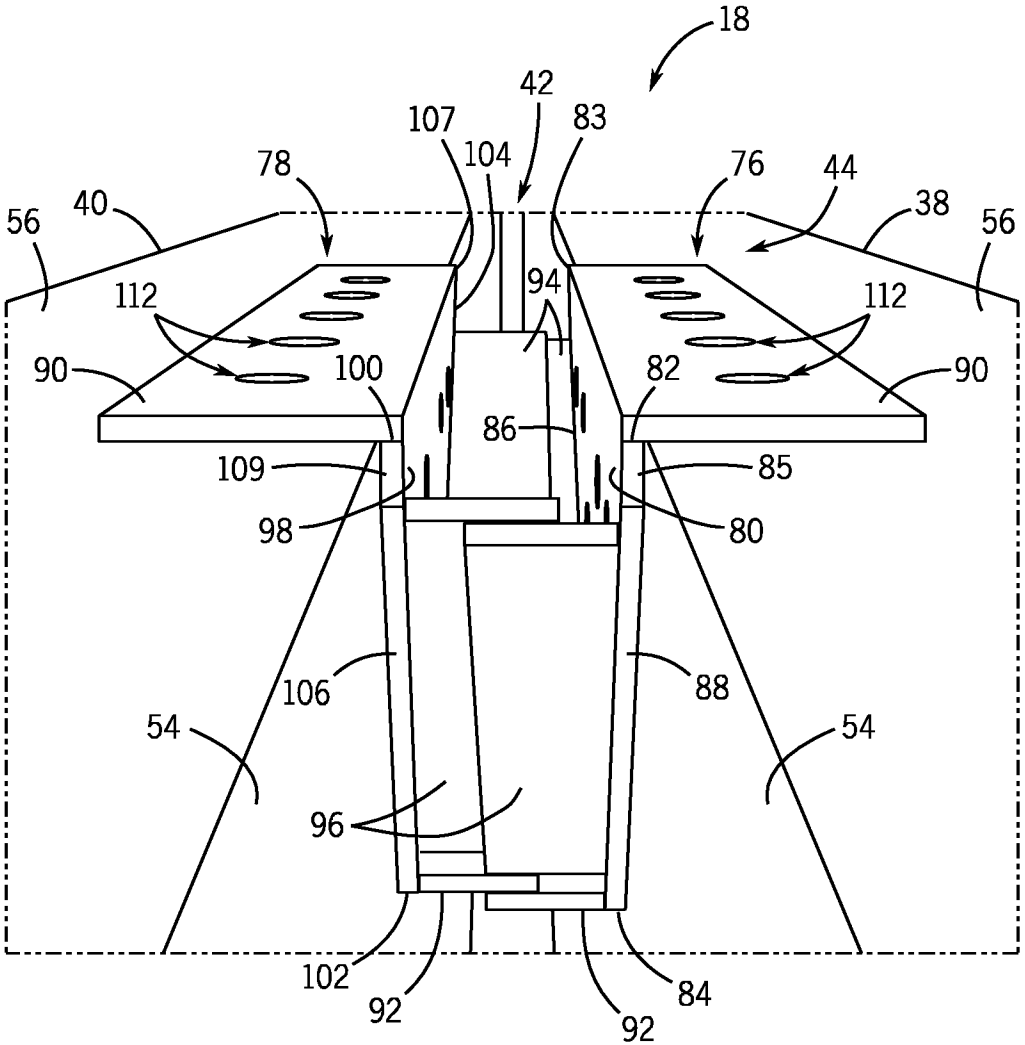
FIG. 8 is a detailed perspective view of the channel connector of FIG. 6 in a gap between channels of the joist of FIG. 3.

Referring now to FIGS. 6-8 with continued referenced to FIGS. 3-5, channel connectors 44 will now be described. FIG. 6 shows a top perspective view of one channel connector 44 of joist 18 of FIG. 3, according to an embodiment of the invention. FIG. 7 shows an exploded view of channel connector 44 of FIG. 6, according to an embodiment of the invention. FIG. 8 shows a detailed view of channel connector 44 positioned between channels 38, 40 of joist 18 of FIG. 3, according to an embodiment of the invention. Initially, while channel connectors 44 are typically used in connection with bent bars 46, 48, channel connectors 44 may be used separately from bent bars 46, 48, as shown via channel connector 44 between first and second bent bars 46, 48 in central section 37*b* of joist 18 in FIG. 3.

Each channel connector 44 includes first and second bent plates 76, 78 positioned partially in gap 42 between channels 38, 40. This is most clearly shown in FIG. 8, where first and second bent plates 76, 78 are positioned within gap 42, but not coupled to each other or to channels 38, 40. First and second bent plates 76, 78 may be formed out of various materials such as, for example, cold-formed steel or structural steel. However, cold-formed steel would be preferred as being the lighter material.

First bent plate 76 is positioned adjacent web first channel 38, and second bent plate is positioned adjacent second channel 40. First bent plate 76 includes a web 80 with a bottom or first parallel edge 82, a top or second parallel edge 84, and first and second angled edges 86, 88 connecting first and second parallel edges 82, 84 via first and second side edges 83, 85. First bent plate 76 also includes a bottom or first parallel flange 90 extending from first parallel edge 82 of web 80, a top or second parallel flange 92 extending from second parallel edge 84 of web 80, and first and second angled flanges 94, 96 extending from first and second angled edges 86, 88, respectively, of web 80.

Second bent plate 78 has a construction similar to that of first bent plate 76. Second bent plate 78 includes a web 98 with a bottom or first parallel edge 100, a top or second parallel edge 102, and first and second angled edges 104, 106 connecting first and second parallel edges 100, 102 via side edges 107, 109. Second bent plate 78 also includes bottom or first parallel flange 90 extending from first parallel edge 100 of web 98, top or second parallel flange 92 extending from second parallel edge 102 of web 98, and first and second angled flanges 94, 96 extending from first and second angled edges 104, 106, respectively, of web 98. Thus, webs 80, 98 of first and second bent plates 76, 78 include the same flanges 90, 92, 94, 96 extending therefrom. Flanges 90, 92, 94, 96 may be either integrated with webs 80, 98 or coupled to webs 80, 98. As a non-limiting example, flanges 90, 92, 94, 96 may be welded onto webs 80, 98.

While first and second bent plates 76, 78 have the same flanges 90, 92, 94, 96, they differ in their respective webs 80, 98. More specifically, webs 80, 98 have the same configuration, but web 80 of first bent plate 76 is taller than web 98 of second bent plate 78 by a thickness of second flange 92. Due to this height difference between webs 80, 98, second parallel flanges 92, first angled flanges 94, and second angled flanges 96 of bent plates 76, 78 overlap or extend across or over each other when each channel connector 44 is assembled. Second flanges 92 include fastener openings 108 therein for fasteners 110 that couple bent plates 76, 78 together. However, in some embodiments, bent plates 76, 78 may be formed as a single bent plate (not shown) in which webs 80, 98 are the same size and are coupled by only one second parallel flange 92, first angled flange 94, and second angled flange 96 extending therebetween and integrated therewith.

Further, in various embodiments, second flanges 92 may not be coupled together with fasteners 110 and may instead be coupled together with channels 38, 40 via fasteners extending through webs 54. That is one of bent plates 76, 78 of each channel connector 44 may be attached to one of channels 38, 40 and bent bars 46, 48 may be poisoned on this channel 38, 40 as well. Thereafter, the other of channels 38, 40 may be brought together with the attached bent plate 76, 78 and bent bars 46, 48. Then the other of bent plates 76, 78 of each channel connector 44 may be slid into gap 42 in alignment with the matching bent plate 76, 78 of each channel connector 44. Thereafter, all of channel connectors 44 may be fastened to channels 38, 40.

First parallel flanges 90 of each web 80, 98 of bent plates 76, 78 include a plurality of fastener openings 112. When channel connectors 44 are positioned in gap 42 between channels 38, 40, first parallel flanges 90 of each web 80, 98 extend over first flanges 56 of channels 38, 40 and fastener openings 112 of first parallel flanges 90 align with fastener openings 62 of first flanges 56 of channels 38, 40 for receipt of fasteners 64, as shown in FIGS. 3-5. While first parallel flanges 90 of bent plates 76, 78 are shown as being parallel with second parallel flanges 92, flanges 90, 92 may not be parallel in all embodiments. As a non-limiting example, if first flanges 56 of channels 38, 40 extend from webs 54 at a different angle, flanges 90 will extend from webs 80, 98 at that same angle so as to align fastener openings 62 with fastener openings 112 of flanges 90 of bent plates 76, 78 while flanges 92 are configured in the manner shown.

Fasteners 64 may be any type of fastener that is able to connect flanges 90 to flanges 56 through fastener openings 112, 62. As a non-limiting example, fasteners 64 may be self-driving or self-tapping screws for quick assembly. However, fasteners 64 may be in another form that results in a slower assembly, such as, for example, nut and bolt fasteners, depending on factors like cost or availability of materials. Fasteners 64 may also be self-drilling screws in various embodiments where fastener openings 62, 112 are not preformed in flanges 56, 90.

Webs 80, 98 of each respective bent plate 76, 78 are positioned adjacent to webs 54 of channels 38, 40, respectively, when channel connectors 44 are positioned in gap 42. Webs 80, 98 of bent plates 76, 78 include a plurality of optional fastener openings 114 that align with optional first fastener openings 70 or optional second fastener openings 72 in webs 54 of channels 38, 40, respectively, for optionally receiving fasteners 64. As similarly explained above with respect to optional fastener openings 70, 72, fastener openings 114 in webs 80, 98 of first and second bent plates 76, 78 are optional due to the use of fasteners 64 in fastener openings 62 in first flanges 56 of channels 38, 40 and fastener openings 112 in first flanges 90 of bent plates 76, 78 of each channel connector 44.

Figure 9:
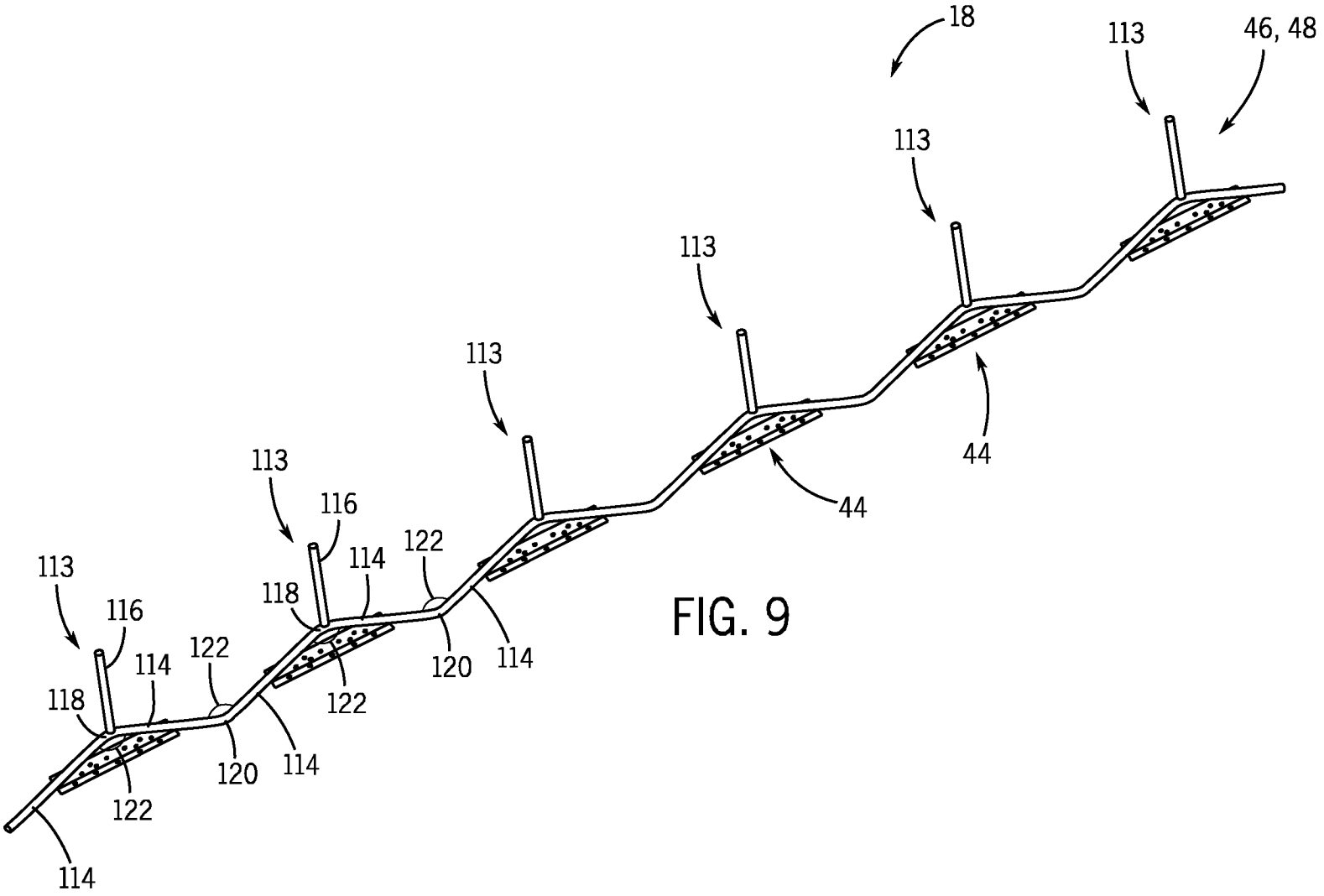
FIG. 9 is a top perspective view of how bent bars are positioned with respect to a plurality of channel connectors in the joist of FIG. 3, according to an embodiment of the invention.
Figure 10:
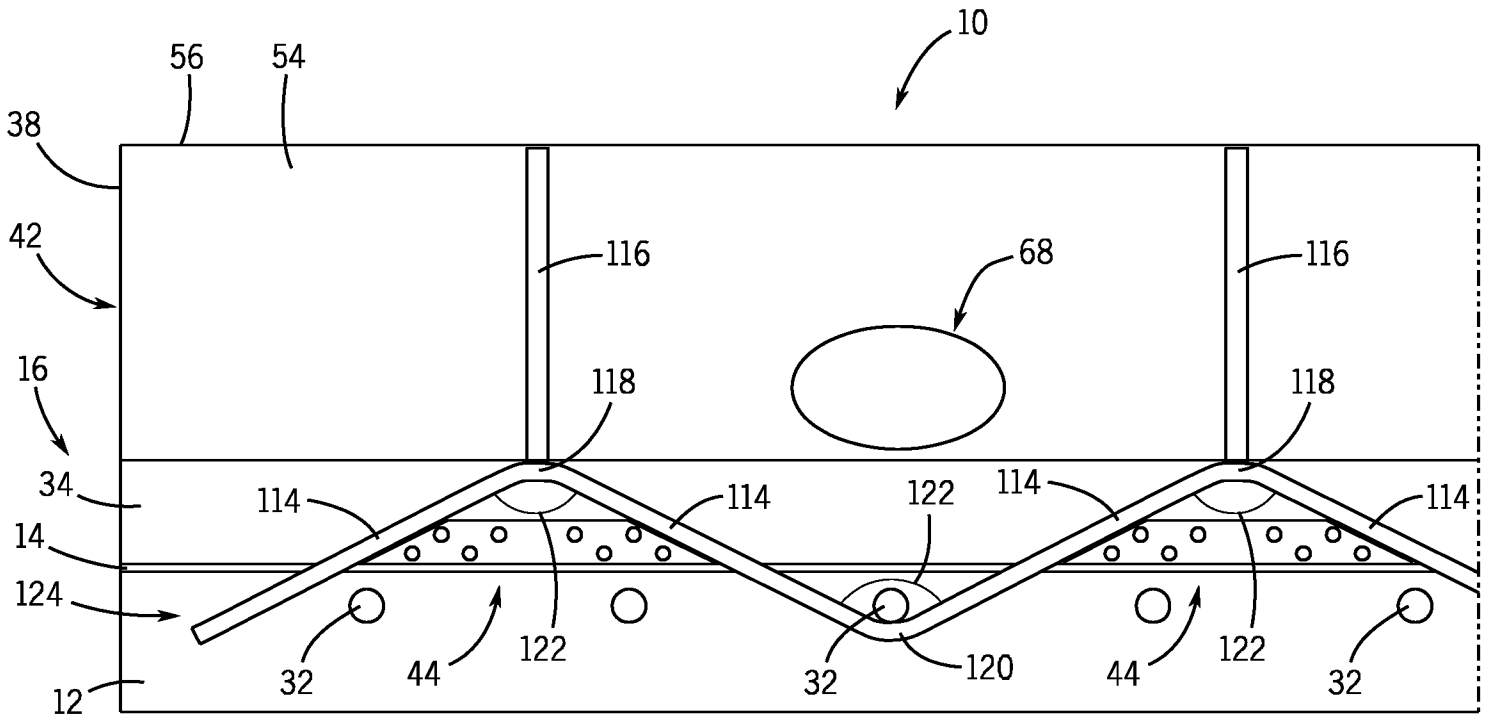
FIG. 10 is a cross-sectional side view of a portion of the floor panel of FIGS. 1 and 2 taken in a gap between the channels of one joist of the floor panel, according to an embodiment of the invention.
Figure 11:
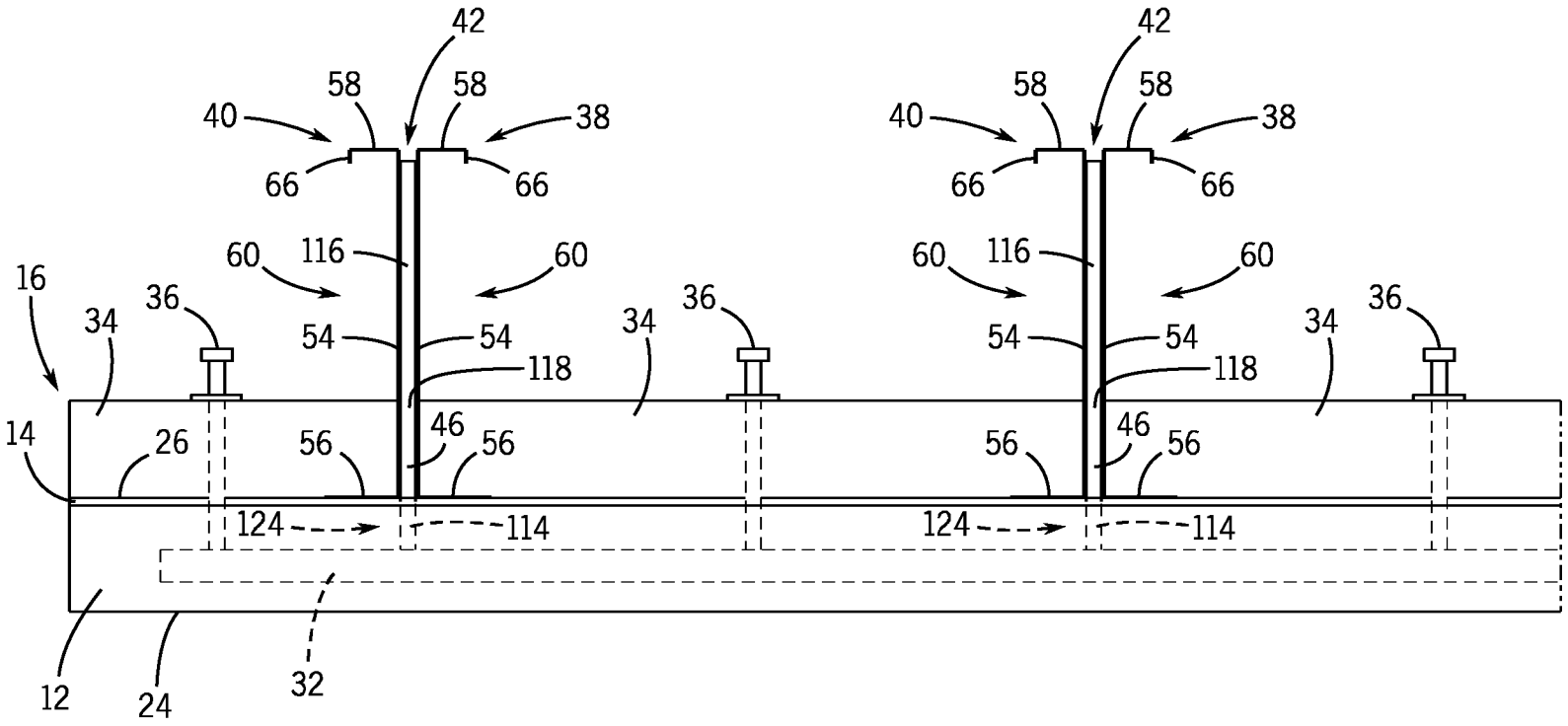
FIG. 11 is a partial end view of the floor panel of FIGS. 1 and 2 along its width, according to an embodiment of the invention.

The configuration bent bars 46, 48 in joist 18 and their arrangement with respect to channels 38, 40, gap 42, and channel connectors 44 will now be described with reference to FIGS. 9-11 with continued reference to FIGS. 3-5. FIG. 9 shows a top perspective view of how first and second bent bars 46, 48 are positioned with respect to a plurality of channel connectors 44 of joist 18 of FIG. 3, according to an embodiment of the invention. FIG. 10 shows a cross-sectional side view of a portion of floor panel 10 of FIGS. 1 and 2 taken in gap 42 between channels 38, 40 of one joist 18 of floor panel 10, according to an embodiment of the invention. FIG. 11 is a partial end view of floor panel 10 of FIGS. 1 and 2 along width 22, according to an embodiment of the invention.

Initially, while joist 18 of FIG. 3 includes first and second bent bars 46, 48 arranged in the same manner, joist 18 may include a different number of bent bars having the same or different lengths. As a non-limiting example, first and second bent bars 46, 48 may be integrated into a single bent bar. As another non-limiting example, joist 18 may include four shorter bent bars. As an additional non-limiting example, joist 18 may include two shorter bent bars and a longer bent bar. Hence, the bent bar configurations shown should not be considered limiting, as the configurations may be varied based on the specific use of and requirements for floor panel 10.

In general, any joist 18 that includes a single bent bar extending its full length is considered fully composite, and any joist 18 that includes multiple bent bars separated by a gap therebetween are considered partially composite. The composite percentage of a fully composite joist 18 is equal to 100%, and the composite percentage of a partially composite joist 18 is equal the total length of the multiple bent bars over the total length of the partially composite joist 18 (usually the length of channels 38, 40 of the partially composite joist 18). Partially composite joists 18 have a lower cost due to the use of less material, but also have a lower flexural or bending capacity. The use of fully composite or partially composite joists 18 will depend on the required capacity for floor panel 10. Typically, partially composite joists 18 will have at least a 60% composite percentage.

Referring to FIG. 9, one bent bar configuration applicable to bent bars 46, 48 is shown. That is, while only one bent bar configuration is shown in FIG. 9, the configuration is applicable to both bent bars 46, 48. In FIG. 9, bent bars 46, 48 include six repeating sections 113 that are defined by their shape and that are arranged with six channel connectors 44. However, since bent bars 46, 48 may be longer or shorter than depicted, bent bars 46, 48 may be arranged with a lesser or greater number of channel connectors 44.

Bent bars 46, 48 include a first plurality of bar sections 114 and a second plurality of bar sections 116. Bar sections 114 may be considered angled bar sections 114, as adjacent bar sections 114 are coupled to each other by a first plurality of joints or bends 118 and a second plurality of joints or bends 120 that create angles 122 between adjacent bar sections 114. As shown most clearly in FIGS. 5 and 10, angled bar sections 114 extend from bends 118 inside gap or internal area 42 between channels 38, 40 to an external area 124 outside of gap 42 and beyond first flanges 56 of channels 38, 40. Since bends 118 are positioned in gap or internal area 42, bends 118 may be considered internal bends 118. On the other hand, since bends 120 are positioned outside of gap 42 and in external area 124, bends 120 may be considered external bends 120. Angled bar sections 114 may either be formed integrally with bends 118, 120 or as separate components that couple to bends 118, 120. Angled bar sections 114 may couple to bends 118, 120 in a variety of ways such as, for example, via an adhesive, a tight fit between components, a threaded coupling, or a quick connect arrangement.

As shown in FIGS. 5, 9, and 10, each bar section 116 of bent bars 46, 48 extends straight out from one internal bend 118 to flanges 58 of channels 38, 40 and is used to help brace channels 38, 40 together, align bent bars 46, 48 in position in gap 42, and maintain the separation between webs 54 of channels 38, 40 via gap 42. Thus, bar sections 116 may be considered support bar sections 116. Support bar sections 116 may either be formed integrally with bends 118 or as a separate component that couples to bends 118 via an adhesive or a tight fit between. Support bar sections 116 may couple to bends 118 using similar methods to those noted above with respect to angled bar sections 114.

The arrangement of bar sections 114, 116 extending from each internal bend 118 forms a ⅄ shape that repeats in bent bars 46, 48 however many times is desired by the manufacturer or builder. This ⅄ shape defines each repeating section 113 in bent bars 46, 48. Each repeating section 113 includes one internal bend 118, a support bar section 116 extending from internal bend 118, and two angled bar sections 114 extending from internal bend 118. Adjacent repeating sections 113 are coupled to each other by one external bend 120. Bent bars 46, 48 may include any number of repeating sections 113 as desired. In some embodiments, repeating sections 113 do not include support bar sections 116 in circumstances such as, for example, when seeking to reduce costs or when channels 38, 40 are short enough that support bar sections 116 are not necessary. In that case, repeating sections 113 of bent bars 46, 48 will have a ⅄ shape defined by one internal bend 118 and two angled bar sections 114 extending from internal bend 118.

When support bar sections 116 are included in bent bars 46, 48, support bar sections 116 may be too tall during installation and extend out of gap 42 beyond second flanges 58 of channels 38, 40. In that case, the manufacturer or builder will cut off the excess portions of support bar sections 116 such that support bar sections 116 are flush with flanges 58 of channels 38, 40. Further, in various embodiments, support bar sections 116 may extend toward flanges 58 at an angle and/or not all the way to flanges 56 of channels 38, 40. Additionally, in various embodiments, each bend 118 may have more than one bar section 116 extending therefrom toward flanges 58 of channels 38, 40.

In general, the taller channels 38, 40 are, the longer support bar sections 116. Angle 122 created by bends 118, 120 may change depending on the height of channels 38, 40. That is, angle 122 may be smaller in taller channels 38, 40 and greater in shorter channels 38, 40. This variability is due to the reduction or increase in available space to make joist 18 structurally sound. Generally, angle 122 may have any measurement that provides adequate strength for the formation of joists 18. As a non-limiting example of a range of such adequate measurements, the measurement of angle 122 may range from 90 degrees to 130 degrees (1.5708 radians to 2.2689 radians). In FIGS. 5, 9, and 10, angle 122 is shown as measuring 126.87 degrees (2.2143 radians).

With regard to angled bar sections 114 of bent bars 46, 48, each angled bar section 114 of bent bars 46, 48 is positioned adjacent one channel connector 44. More specifically, each angled bar section 114 is supported by either first angled flanges 94 or second angled flanges 96 of first and second bent plates 76, 78 of one channel connector 44 in gap 42. In order to allow angled bar sections 114 to be evenly supported by channel connectors 44, an angle formed between first and second angled flanges 94, 96 in each channel connector 44 matches or substantially matches angle 122 formed by bends 118 between adjacent bar sections 114. In other words, angled flanges 94, 96 of each channel connector 44 have the same or substantially the same slope as angled bar sections 114 of bent bars 46, 48. With bent bars 46, 48 and channel connectors 44 utilizing the same angle 122, angled bar sections 114 of bent bars 46, 48 ideally rest on angled flanges 94, 96 of each channel connector 44 without any gaps therebetween. However, in practice, the slope of angled bar sections 114 and angled flanges 94, 96 need not be exact, and minimal gaps therebetween are acceptable according to normal industry tolerances. As a non-limiting example, a gap of ⅛ inches (0.3175 centimeters) is generally acceptable.

FIGS. 10 and 11 illustrate that external area 124 resides within concrete layer 12 when joist 18 is in floor panel 10. During manufacture of floor panel 10, the manufacturer or builder will insert the portion(s) of each bent bar 46, 48 outside of gap 42 and in external area 124 into concrete layer 12 either directly or through insulation layer 14 before concrete layer 12 has cured. The curing of concrete layer 12 will couple joists 18 and concrete layer 12 together. Preferably, but not necessarily, angled bar sections 114 of bent bars 46, 48 extend to external bends 120 of bent bars 46, 48 at least halfway (at least 50%) through concrete layer 12 from bottom surface 26 toward top surface 24. As a non-limiting example, if concrete layer 12 is 2½ inches (6.35 centimeters) thick between top and bottom surfaces 24, 26, angled bar sections 114 may extend to external bends 120 positioned 1¼ inches (3.175 centimeters) into concrete layer 12 from bottom surface 26.

In various embodiments, the manufacturer or builder may optionally insert widthwise rebars 32 through bent bars 46, 48 at external bends 120 to aid in coupling joists 18 to concrete layer 12 while providing additional tensile strength to concrete layer 12. That is, widthwise rebars 32 may be positioned through bends 120 of bent bars 46, 48 instead of outside of bent bars 46, 48, as shown in FIG. 11, or in addition to widthwise rebars 32 positioned outside of bent bars 46, 48.

Each bent bar 46, 48 is preferably formed of an electrically non-conductive material with a low thermal conductivity/high thermal resistance to provide a lower heat transfer between channels 38, 40 and bent bars 46, 48 of joist 18 and between bent bars 46, 48 and concrete layer 12. Non-limiting examples of such materials are basalt, glass, or carbon fiber reinforced polymer (FRP) materials, products, or composites. FRP composites are beneficial for use in bent bars 46, 48 for reasons other than for its thermal resistance/conductivity such as, for example, for its fire safety, corrosion resistance, and light-weight properties. Further, since FRP composites are already heat resistant, FRP composites do not require the addition of any toxic chemical coatings to make them heat resistant like wood, concrete, and steel, as non-limiting examples.

In combination with first insulation layer 14 between channels 38, 40 of joists 18 and concrete layer 12, the material of bent bars 46, 48 is selected to create a thermal break to eliminate at least 90% of the thermal bridging between concrete layer 12 and channels 38, 40 of joists 18. In embodiments where first insulation layer 14 is replaced with an air gap (not shown), as described above, the thermal break created may eliminate at least 86% of the thermal bridging between concrete layer 12 and channels 38, 40 of joists 18. In either case, the use of and bent bars 46, 48 along with first insulation layer 14 or an air gap prevents a direct connection between channels 38, 40 of joists 18 and concrete layer 12, and the material of bent bars 46, 48 lessens the thermal transfer between concrete layer 12 and channels 38, 40. The thermal break created allows for floor panel 10 to withstand extremely high or low outdoor temperatures and maintain warmer temperatures in an interior of a building, while the overall configuration of floor panel 10 provides structural integrity to the building. The higher the thermal efficiency of construction panel 10, the more consumers can save on utility bills. As noted above, FRP materials have the characteristics necessary to provide these benefits when used in bent bars 46, 48. Furthermore, they can be used to meet new and proposed construction codes and standards relating to energy efficiency and reduction of carbon emissions.

While bent bars 46, 48 are preferably formed of an electrically non-conductive material with a low thermal conductivity/high thermal resistance to create the above-described thermal break, other non-preferable materials may be used when necessary or allowable. As a non-limiting example, bent bars 46, 48 may be formed of steel rebars. This may be necessary when preferred materials are in short supply or cost-prohibitive and may be allowable when the increased thermal efficiency provided by the preferred materials is not essential. The preferred materials may not be essential when floor panel 10 is used in an interior of a building where is no need for a high thermal efficiency, as a non-limiting example.

Figure 13:
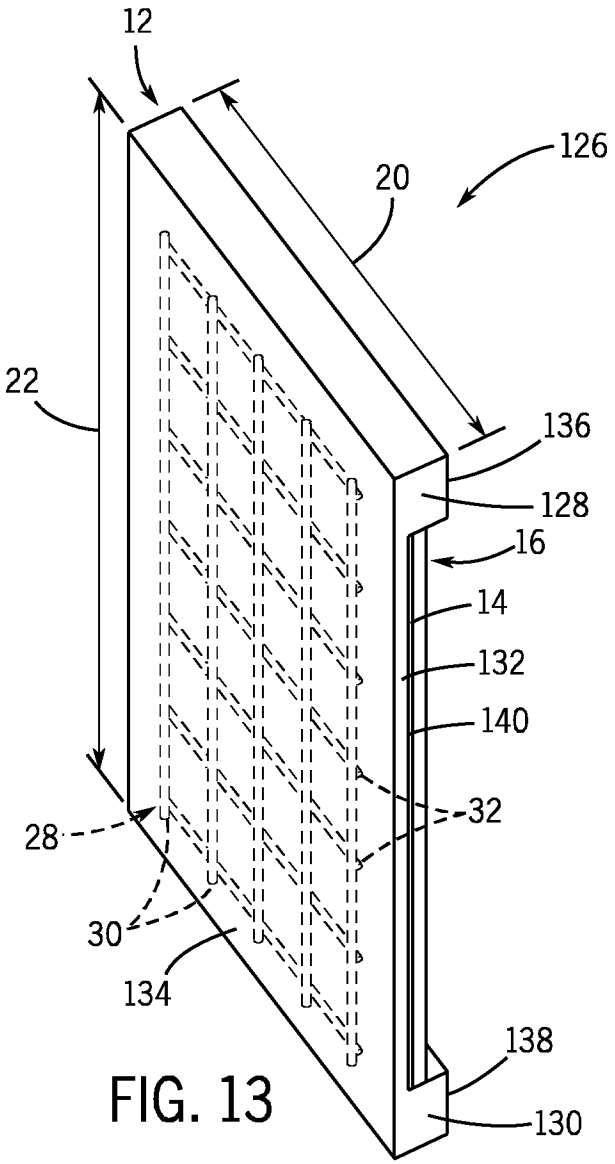
FIGS. 12 and 13 are respective interior and exterior perspective views of a construction panel in the form of a wall panel, according to an embodiment of the invention.
Figure 12:
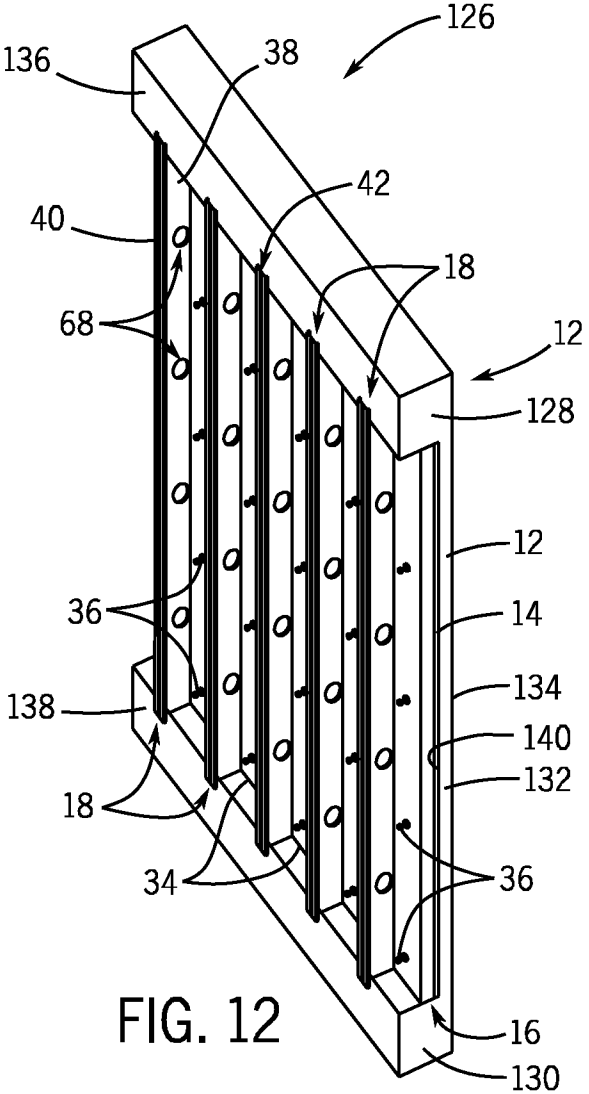

Referring now to FIGS. 12 and 13, respective interior and exterior perspective views of a construction panel 126 are shown, according to an embodiment of the invention. Construction panel 126 of FIGS. 12 and 13 is arranged similarly to construction panel 10 of FIGS. 1 and 2, and, thus, like elements therein are numbered identically to corresponding elements in construction panel 10. The main difference between construction panel 10 of FIGS. 1 and 2 and construction panel 126 of FIGS. 12 and 13 is that construction panel 10 is arranged as a floor panel and construction panel 126 is arranged as a wall panel. As such, the overall configuration of construction panel 126 is similar to that of construction panel 10, but construction panel 126 is modified for use in a wall.

Wall panel 126 includes a concrete layer or wythe 12, a first insulation layer 14, a second insulation layer 16, and a plurality of framing members 18. As such, wall panel 126 includes the same components as floor panel 10, but arranged in a configuration specific to constructing a wall. Initially, while framing members 18 described above with respect to FIGS. 1-11 are called joists 18 in floor panel 10, framing members 18 of FIGS. 12 and 13 in construction panel 126 are called studs 18 since construction panel 126 is a wall panel. Studs 18 in wall panel 126 may be spaced apart at a different distance than joists 18 in floor panel 10. However, studs 18 in wall panel 126 have the same components arranged in same way as those of joists 18 described with respect to FIGS. 1-11.

The differences between the components of studs 18 in FIGS. 12-13 and joists 18 in FIGS. 1-11 are typically those related to differences between the construction of walls and floors. As a non-limiting example, channels 38, 40, channel connectors 44, and bent bars 46, 48 of studs 18 may be sized differently in terms of length, width, thickness, and/or height than those in joists 18. A more specific non-limiting example regarding size differences might be that, in wall panel 126, channels 38, 40 in studs 18 may not need to be as tall as channels 38, 40 in joists 18 of floor panel 10. In that case, support bars 116 of bent bars 46, 48 will either be shorter in studs 18 or be removed as unnecessary.

Another more specific non-limiting example regarding size differences might be that, in wall panel 126, studs 18 may be shorter and, therefore, have less channel connectors 44 and/or bent bars 46, 48 and/or a different number of repeating sections in bent bars 46, 48 (for example two repeating sections 113 in studs 18 versus six repeating sections 113 in joints 18 of floor panel 10). As yet another non-limiting example of differences between studs 18 and joists 18, channels 38, 40 of studs 18 may have a different number of openings 68 for mechanical, electrical, and plumbing installations. However, these characteristics noted with regard to how studs 18 of wall panel 126 may be different from joists 18 of floor panel 10 are variable in joists 18, as described above. The variable characteristics explained above with respect to joists 18 of FIGS. 1-11 are also applicable to studs 18 of wall panel 126. That is, the components of studs 18 and joists 18 are generally variable to the extent allowable for their intended use.

Like concrete layer 12 of floor panel 10 of FIGS. 1-2, concrete layer 12 has a width 20 and a length 22, though width 20 and length 22 may be different in wall panel 126. However, concrete layer 12 of wall panel 126 has a somewhat different configuration in terms of thickness. More specifically, concrete layer 12 of wall panel 126 includes a top or first outer concrete section 128, a bottom or second outer concrete section 130, and a central concrete section 132 between outer concrete sections 128, 130. Each concrete section 128, 130, 132 extends from an exterior surface 134 of concrete layer 12.

However, outer concrete sections 128, 130 are thicker than central concrete section 132. First outer concrete section extends from exterior surface 134 to a top or first outer interior surface 136, second outer concrete section 130 extends from exterior surface 134 to a bottom or second outer interior surface 138, and central concrete section 132 extends from exterior surface 134 to a central interior surface 140. Central interior surface 140 functions in the same manner as bottom surface 26 of floor panel 10 of FIGS. 1 and 2 with respect to joists 18. That is, components of bent bars 46, 48 extending into external area 124 extend into central concrete section 132 through central interior surface 140. Outer interior surfaces 136, 138 may be aligned with each other such that outer concrete sections 128, 130 have the same thickness, or one of outer interior surfaces 136, 138 may be positioned farther from exterior surface 134 that the other such that one of outer concrete sections 128, 130 is thicker than the other.

Outer concrete sections 128, 130 are generally included in wall panel 126 to support studs 18. That is, channels 38, 40 of studs 18 extend into outer concrete sections 128, 130 such that outer concrete sections 128, 130 brace studs 18 therein. The extent to which channels 38, 40 extend into outer concrete sections 128, 130 may range from 1 inch (2.54 centimeters) to the full thickness of outer concrete sections 128, 130. Outer interior surfaces 136, 138 of outer concrete sections 128, 130 may extend up to flanges 58 of channels 38, 40 of studs 18.

When bracing studs 18 with outer concrete sections 128, 130 of concrete layer 12, channels 38, 40 of studs 18 have a direct connection to concrete layer 12. While this direct connection reduces the thermal efficiency of wall panel 126, the reduction in thermal efficiency is typically less than 10% due to the arrangement of insulation layers 14, 16. Further, using outer concrete sections 128, 130 to brace studs 18 renders the use of top and bottom tracks (not shown) on wall panel 126 unnecessary. However, top and bottom tracks may be used as an alternative to outer concrete sections 128, 130 if desired. In that case, the tracks may be formed out of cold-formed steel or structural steel, as non-limiting examples.

In various embodiments, concrete layer 12 also includes rebar grid 28 with lengthwise and widthwise rebars 30, 32 positioned between exterior surface 134 and first outer, second outer, and central interior surfaces 136, 138, 140 to increase the tensile strength of concrete layer 12. While FIG. 13 shows rebar grid 28 with a specific number of lengthwise and widthwise rebars 30, 32 having a substantially cylindrical shape, this configuration of rebar grid 28 is non-limiting. For example, rebar grid 28 may include more or less lengthwise and/or widthwise rebars 30, 32, rebars extending in different directions, rebars in different locations, rebars having different shapes, rebars having different shapes, or various combinations of the above. The configuration of rebar grid 28 will depend on the goals for construction.

During manufacture or casting of wall panel 126, rebar grid 28 may be positioned in formwork prior to pouring concrete layer 12 using supports or chairs (not shown) to position rebar grid 28 at the right height above the ground or floor. The supports may be made of metal, plastic, or other non-corrosive materials. For example, the supports may be in the form of dobies (not shown), which are small concrete blocks. Alternatively, at least a portion of rebar grid 28 may be pushed down into concrete layer 12 from above. In some embodiments, widthwise rebars 32 may be pushed into concrete layer 12 while extending through bent bars 46, 48 in studs 18. However, rebar grid 28 may not always be necessary such as, for example, where wall panel 126 will not be used for structural purposes.

First insulation layer 14 is positioned over or across central interior surface 140 of central concrete section 132 of concrete layer 12 between central interior surface 140 of central concrete section 132 of concrete layer 12 and second insulation layer 16. That is, first insulation layer 14 covers the entirely of central interior surface 140 of concrete layer 12. However, in various embodiments, first insulation layer 14 may cover one or more sections of central interior surface 140 of concrete layer 12. As a non-limiting example, first insulation layer 14 may cover central interior surface 140 of concrete layer 12 where studs 18 are positioned in wall panel 126.

Studs 18 of wall panel 126 are coupled to central concrete layer 132 of concrete layer 12 in the same manner that joists 18 are coupled to concrete layer 12 of floor panel 10 of FIGS. 1 and 2. That is, during manufacture of wall panel 126, the manufacturer or builder will insert the portion(s) of each bent bar 46, 48 outside of gap 42 and in external area 124 into central concrete section 132 of concrete layer 12 either directly or through insulation layer 14 before concrete layer 12 has cured. The curing of concrete layer 12 will couple studs 18 and concrete layer 12 together. Preferably, but not necessarily, angled bar sections 114 of bent bars 46, 48 extend to external bends 120 of bent bars 46, 48 at least halfway (at least 50%) through concrete layer 12 from central interior surface 140 to exterior surface 134. As a non-limiting example, if central concrete section 132 of concrete layer 12 is 3¾ inches (9.525 centimeters) thick between exterior and central interior surfaces 134, 140, angled bar sections 114 may extend to external bends 120 positioned 2 inches (5.08 centimeters) into central concrete section 132 from central interior surface 140. As another non-limiting example, if concrete layer 12 is 2¼ inches (5.715 centimeters) thick between exterior and central interior surfaces 134, 140, angled bar sections 114 may extend to external bends 120 positioned 1³⁄₁₆ inches (3.01625 centimeters) into concrete layer 12 from central interior surface 140.

In various embodiments, insulation layer 14 may be omitted from wall panel 126 in order to save on cost where wall panel 126 does not require a high thermal efficiency. However, the inclusion of first insulation layer 14 or an air gap (not shown) is generally desirable to create a thermal break between channels 38, 40 of studs 18 and central concrete section 132 of concrete layer 12. That is, as similarly explained above with respect to floor panel 10 of FIGS. 1 and 2, the use of bent bars 46, 48 of studs 18 extending through insulation layer 14 or an air gap in wall panel 126 prevents a direct connection between channels 38, 40 of studs 18 and central concrete section 132 of concrete layer 12, and the material of bent bars 46, 48 lessens the thermal transfer between concrete layer 12 and channels 38, 40.

This thermal break allows for wall panel 126 to withstand extremely high or low outdoor temperatures and maintain warmer temperatures in an interior of a building, while the overall configuration of wall panel 126 provides structural integrity to the building. The higher the thermal efficiency of construction panel 126, the more consumers can save on utility bills. As noted above, FRP materials have the characteristics necessary to provide these benefits when used to form bent bars 46, 48. Furthermore, they can be used to meet new and proposed construction codes and standards relating to energy efficiency and reduction of carbon emissions.

Second insulation layer 16 is generally positioned over or across first insulation layer 14 and against studs 18. In embodiments where first insulation layer 14 is omitted from wall panel 126, second insulation layer 16 may be positioned either only against studs 18 or against studs 18 and over or across central interior surface 140 of central concrete section 132 of concrete layer 12, depending on whether an air gap is present between studs 18 and central interior surface 140 of central concrete section 132 of concrete layer 12. Second insulation layer 16 includes insulation sections 34 positioned on each side of studs 18. First insulation layer 14 is much thinner than second insulation layer 16. As a non-limiting example, first insulation layer 14 may be ¼ of an inch (0.635 centimeters) and second insulation layer 16 may be at least 3 inches (7.62 centimeters). However, insulation layer 16 may be even thicker than depicted in FIGS. 12 and 13, depending on the clearance allowed by studs 18, the need for additional insulation, and the need to install mechanical, electrical, or plumbing components in wall panel 126.

The insulation for first and second insulation layers 14, 16 may be in any form suitable for use in a construction panel such as, for example, rigid foam board insulation, which is shown as a non-limiting example in FIGS. 12 and 13, or spray foam insulation. Where the insulation is rigid foam board insulation, spray foam insulation may be used to seal gaps, such as, for example, between the rigid foam board insulation and the framing members. In some embodiments, the rigid foam board will include a radiant barrier sheet (not shown) attached thereto to provide additional strength to the rigid foam board insulation. Also, as shown in FIG. 12, pins or connectors 36 may be used to couple insulation layers 14, 16 to concrete layer 12 by inserting them through insulation layers 14, 16 and into concrete layer 12 and allowing concrete layer 12 to cure. Connectors 36 are typically made of plastic to reduce heat transfer, but may be made of other materials, such as, for example, metal, when desired or necessary. The number, shape, and size of connectors 36 shown are merely exemplary and will vary based on need.

Figure 15:
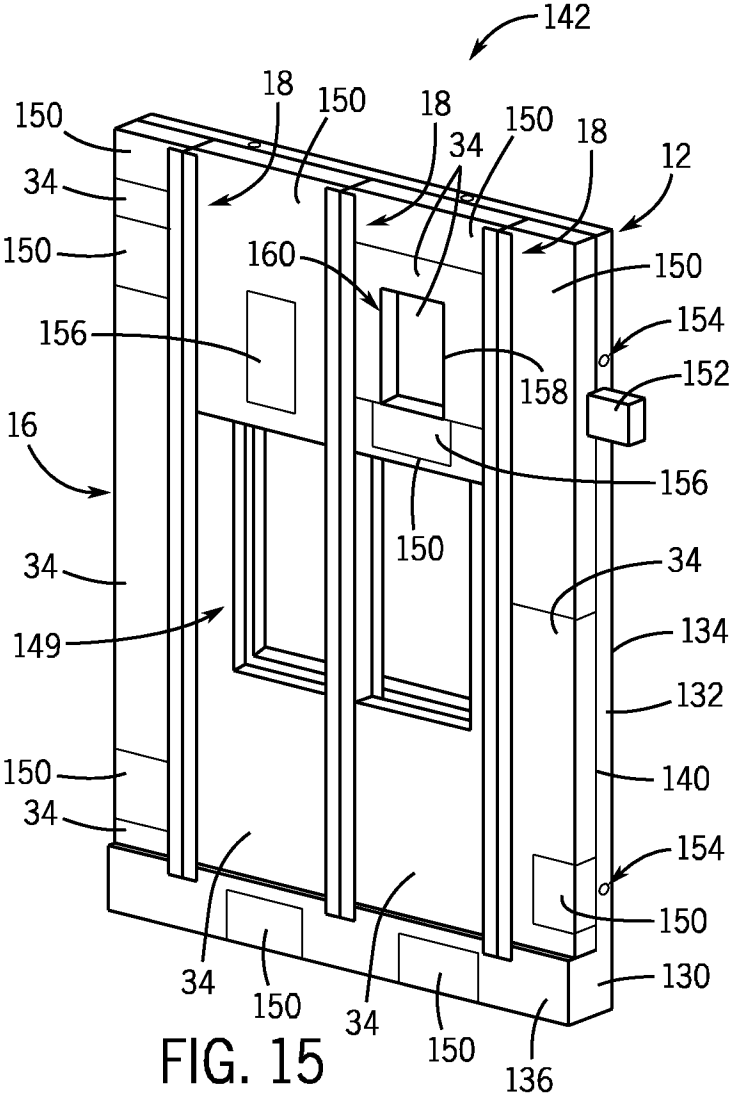
FIGS. 14 and 15 are respective exterior and interior perspective views of a construction panel in the form of a wall panel, according to another embodiment of the invention.
Figure 14:
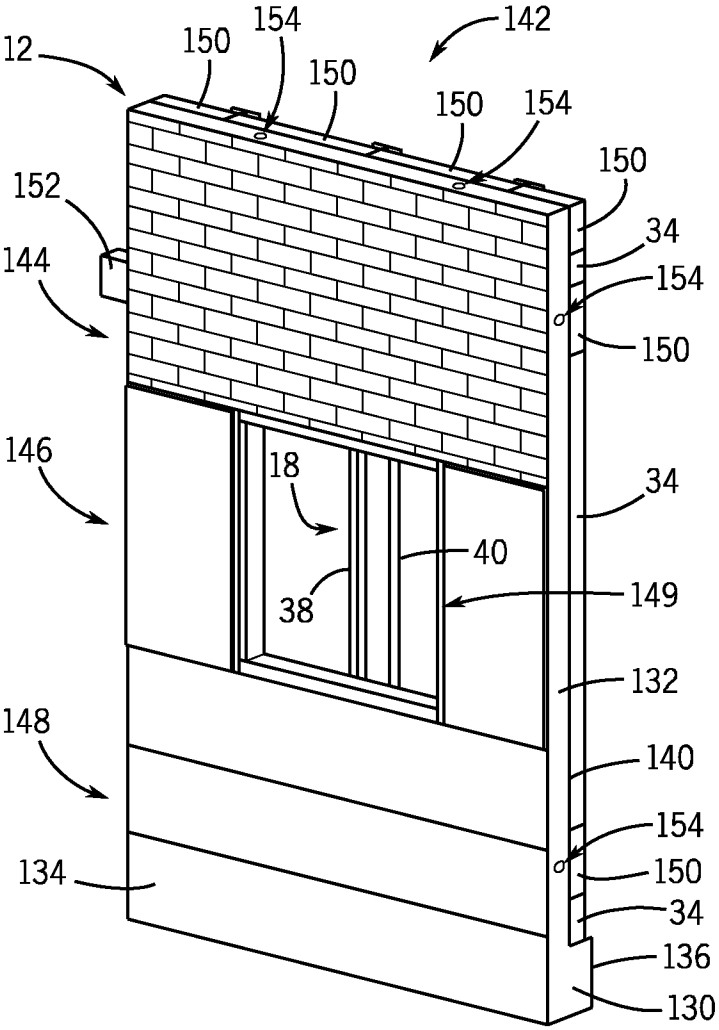

Referring now to FIGS. 14 and 15, respective exterior and interior perspective views of a construction panel 142 are shown, according to another embodiment of the invention. Construction panel 142 of FIGS. 14 and 15 is arranged similarly to construction panel 126 of FIGS. 12 and 13, and, thus, like elements therein are numbered identically to corresponding elements in construction panel 126. Like construction panel 126 of FIGS. 12 and 13, construction panel 142 is arranged as a wall panel. The main difference between wall panel 126 of FIGS. 12 and 13 and wall panel 142 is that wall panel 142 includes many optional features for inclusion in wall panel 126. As such, the overall configuration of wall panel 142 will be described in terms of modifications from the overall configuration of wall panel 126 in order to describe optional features that may be incorporated into wall panel 126. While wall panel 142 may be described to show optional features that may be included in wall panel 126 of FIGS. 12 and 13, any features that are also applicable to floor panels may be incorporated into floor panel 10 of FIGS. 1 and 2.

Initially, concrete layer 12 in wall panel 142 has a different configuration from concrete layer 12 of wall panel 126 of FIGS. 12 and 13. While concrete layer 12 includes outer concrete section 130 and central concrete section 132, concrete layer 12 does not include outer concrete section 128. Further, exterior surface 134 of concrete layer 12 is modified to show different finishes that may be applied in contrast with an as-cast finish in which exterior surface 134 is left as is after casting. FIG. 14 shows exterior surface 134 with three different exemplary finish sections 144, 146, 148. However, over 100 different finishes may be applied to exterior surface 134 including, but not limited to, different variations of brick, stone, reveals, projections, exposed aggregate, abrasive blasted, acid-etched, and form finishes (with or without formliners). Further, different colors, textures, patterns, and shapes may be applied to exterior surface 134 with these finishes.

Wall panel 142 also includes a window opening 149. One stud 18 is extending across window opening 149. While stud 18 extending across window opening 142 may be cut out of window opening 149, wall panel 142 is designed to allow any type or size of opening to be used therein without the need to cut studs 18. That is, in general, the design of wall panel 142 allows for a stud 18 to extend across an opening without interfering with installation of an object in the opening. Alternatively, in various embodiments and circumstances, wall panel 142 may be configured to account for window opening 149 such that studs 18 are positioned on either side of window opening 149.

Concrete layer 12 in wall panel 142 also differs from concrete layer 12 of wall panel 126 of FIGS. 12 and 13 in including concrete blocks 150 in central concrete section 132. These concrete blocks 150 are thicker sections of concrete formed to support a variety of different features. While concrete blocks 150 are shown in FIGS. 14 and 15 as an additional layer of concrete to concrete layer 12, this is only to emphasize the location of concrete blocks 150. In general, concrete blocks 150 will be formed as part of the same concrete pour as central concrete section 132 of concrete layer 12 and will, therefore, cure with and be integral to central concrete section 132. One feature of wall panel 142 that requires a concrete block 150 is a D beam 152 for connecting to other panels. Further, some concrete blocks 150 are solid concrete block-outs for heavy-duty connection embeds 154, in which lifting bolts and the like may be inserted for a crane to lift wall panel 142. Additionally, embed plates 156 are included for attaching external framing components thereto. Wall panel 142 also includes a support 158 having an opening 160. Support 158 may receive and support framing members external to wall panel 142 such as, for example, structural steel beams or joist girders.

As shown, inclusion of concrete blocks 150 results in a direct connection between studs 18 and concrete layer 12. This will decrease the thermal efficiency of wall panel 142 in comparison to wall panel 126 of FIGS. 12 and 13. However, concrete blocks 150 are necessary for structural integrity. The depiction of wall panel 142 is meant show possible additional features that may not be included in a single wall panel like shown in wall panel 142, which would result in mitigating the reduction in thermal efficiency.

Insulation sections 34 of insulation layer 16 in wall panel 142 are positioned wherever possible. That is, insulation sections 34 are included where concrete blocks 150 are not necessary to support components of wall panel 42. One insulation section 34 may also be placed in support 158. Insulation section 14 is not shown in FIGS. 14 and 15 for purposes of clarity, but may be included at least between channels 38, 40 of framing members 18 and concrete layer 12, as described above, to provide at least some thermal separation between channels 38, 40 of framing members 18 and concrete layer 12.

A method manufacturing a construction panel, such as, for example, construction panel 10 of FIGS. 1 and 2, construction panel 126 of FIGS. 12 and 13, and construction panel 142 of FIGS. 14 and 15, will now be described. The method is generally applicable to each construction panel 10, 126, 142 due to commonalities in their overall design. Initially, concrete is poured into formwork (not shown). The formwork may include block-outs for window or door openings or other features for the construction panel. Further, the formwork may further include exterior finishes such as, for example, brick, stone, formliners, reveals, and/or projections. The formwork may also include rebar grid 28 positioned therein. If the formwork includes exterior finishes, rebar grid 28 will be positioned in the formwork after and over the top of the exterior finishes.

During the concrete pour, framing members 18 may be assembled. To assemble framing members 18, channel connectors 44 and bent bars 46, 48 are appropriately positioned within gap 42 between webs 54 of channels 38, 40. Channels 38, 40 are coupled to each other with fasteners 64 through fastener openings 62 in flanges 56 of channels 38, 40 and fastener openings 112 in first parallel flanges 90 of first and second bent plates 76, 78 of each channel connector 44.

Once the concrete pour is ready, first insulation layer 14 may be positioned over concrete layer 12, and assembled framing members 18 may be coupled to concrete layer 12 by inserting the portions of angled bar sections 114 of bent bars 46, 48 and external bends 120 in external area 124 into concrete layer 12. Framing members 18 may be spaced apart according to the design prior to coupling them to concrete layer 12 to ensure proper spacing or may be coupled to concrete layer 12 separately. Rebars may also be attached to framing member 18 for insertion into concrete layer 12 with framing members 18. Rebars may also be positioned in concrete layer 12 from above as necessary to support additional structural components added.

Thereafter, insulation sections 34 of second insulation layer 16 may be positioned over first insulation layer 14, against framing members 18, and/or over concrete layer 12. Insulation sections 34 may be sealed against framing members 18, as desired. Insulation layers 14, 16 are then coupled to concrete layer 12 with connectors 36 or via devices or methods. Structural components such as D beam 152, heavy-duty connection embeds 154, or support 158 may be added as well. If additional structural components are added, the formwork includes a block-out for an opening, or the construction panel is designed to include either of outer concrete sections 128, 130, as non-limiting examples, the concrete pour may be continued to provide the correct thickness of concrete for concrete layer 12. That is, the additional concrete added is considered part of the same concrete pour since the original concrete poured has not yet cured and the additional concrete will cure with the original concrete to form one concrete layer. However, continuing the concrete pour may not be necessary. Once concrete layer 12 is at the appropriate height, the concrete must cure. Embed plates 156 may be added to concrete layer 12 during or after curing. Once the concrete has cured into concrete layer 12, the precast construction panel is ready for installation.

Figure 16:
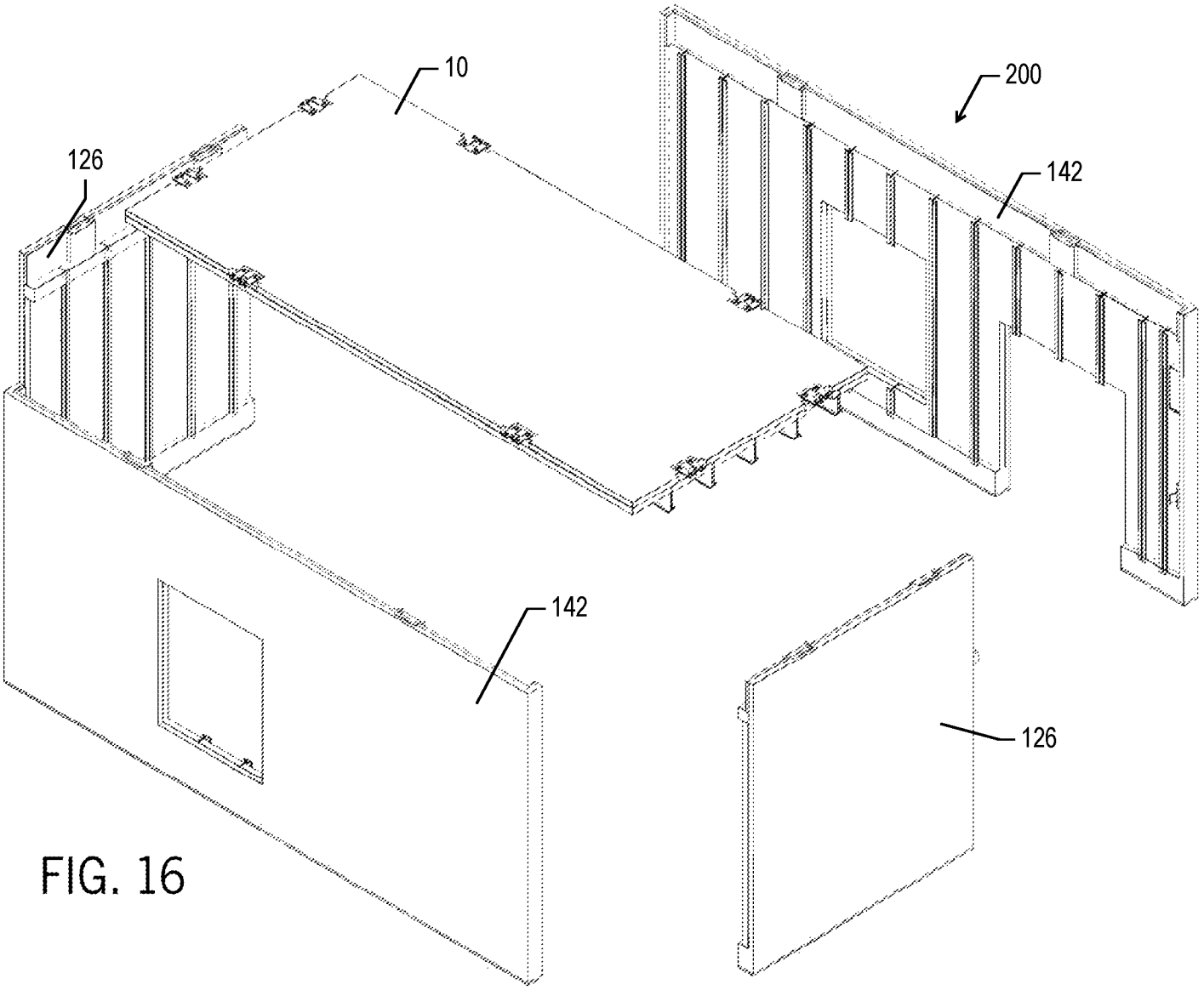
FIGS. 16 and 17 are exploded perspective and perspective views, respectively, of a construction panel module constructed with the construction panels of FIGS. 1, 2, and 12-15, according to an embodiment of the invention.
Figure 17:
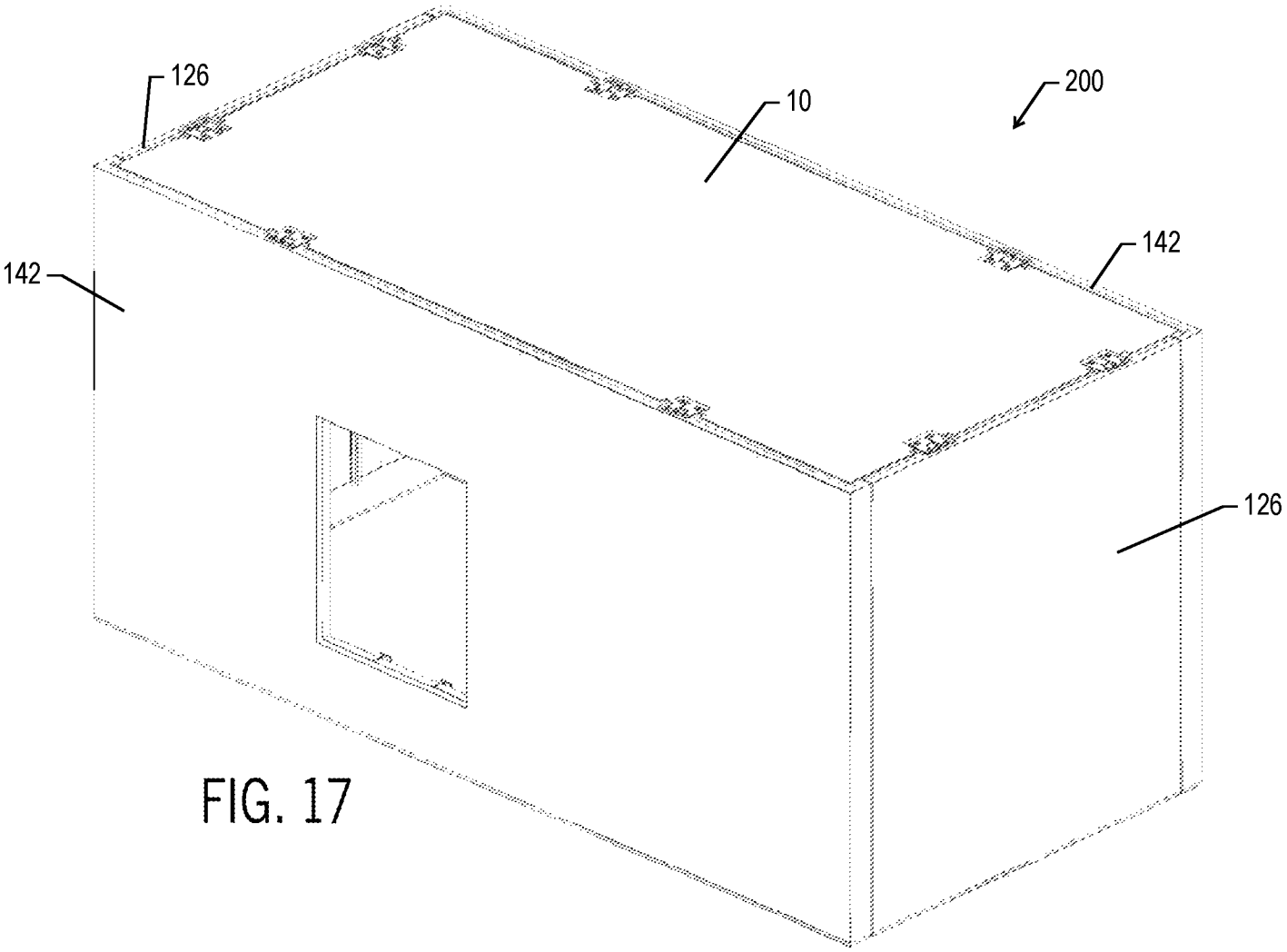
Figure 18:
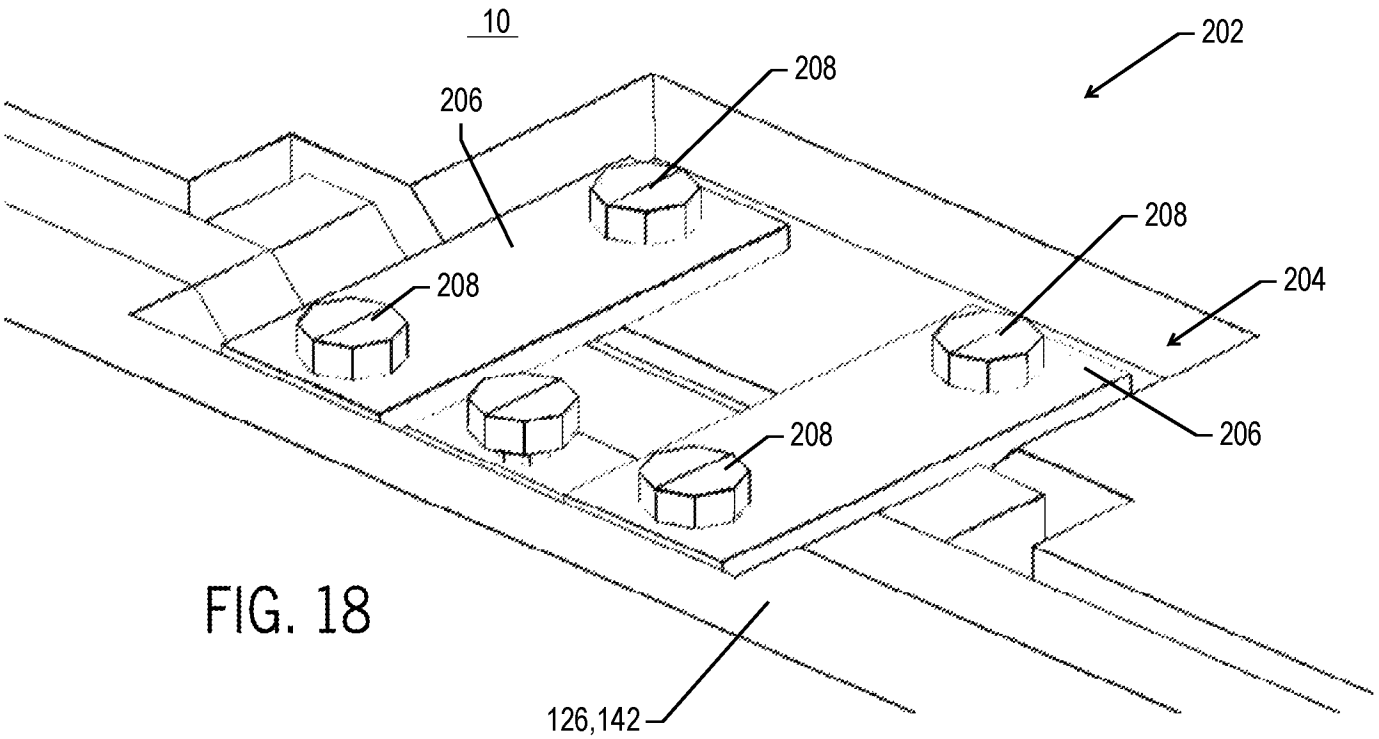
FIG. 18 is a detailed view of a connection between construction panels in FIG. 17, according to an embodiment of the invention.
Figure 19:
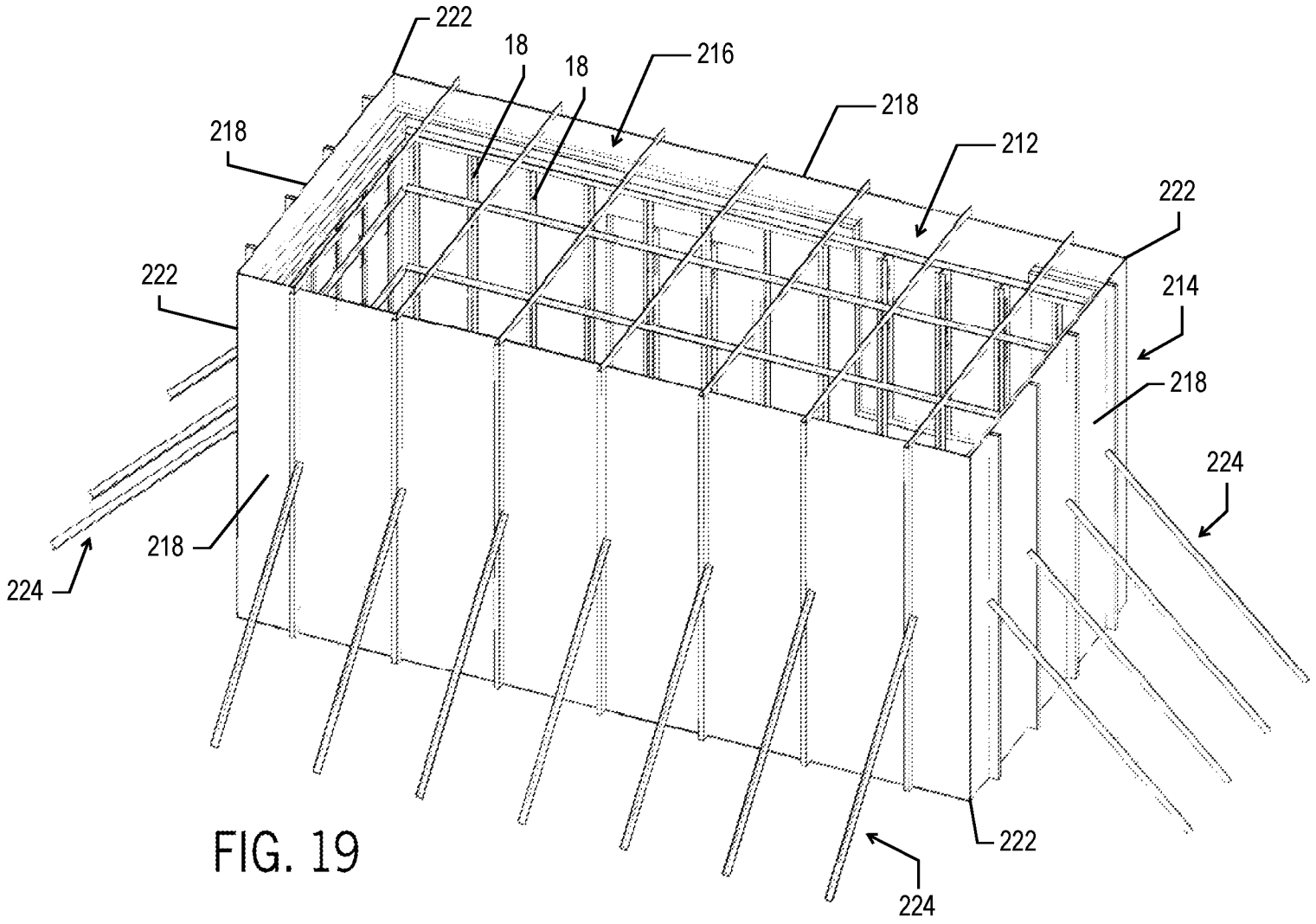
FIGS. 19-22 are perspective views of a technique for manufacturing a single pour construction panel module using the framing members of FIGS. 3-9, according to an embodiment of the invention.
Figure 20:
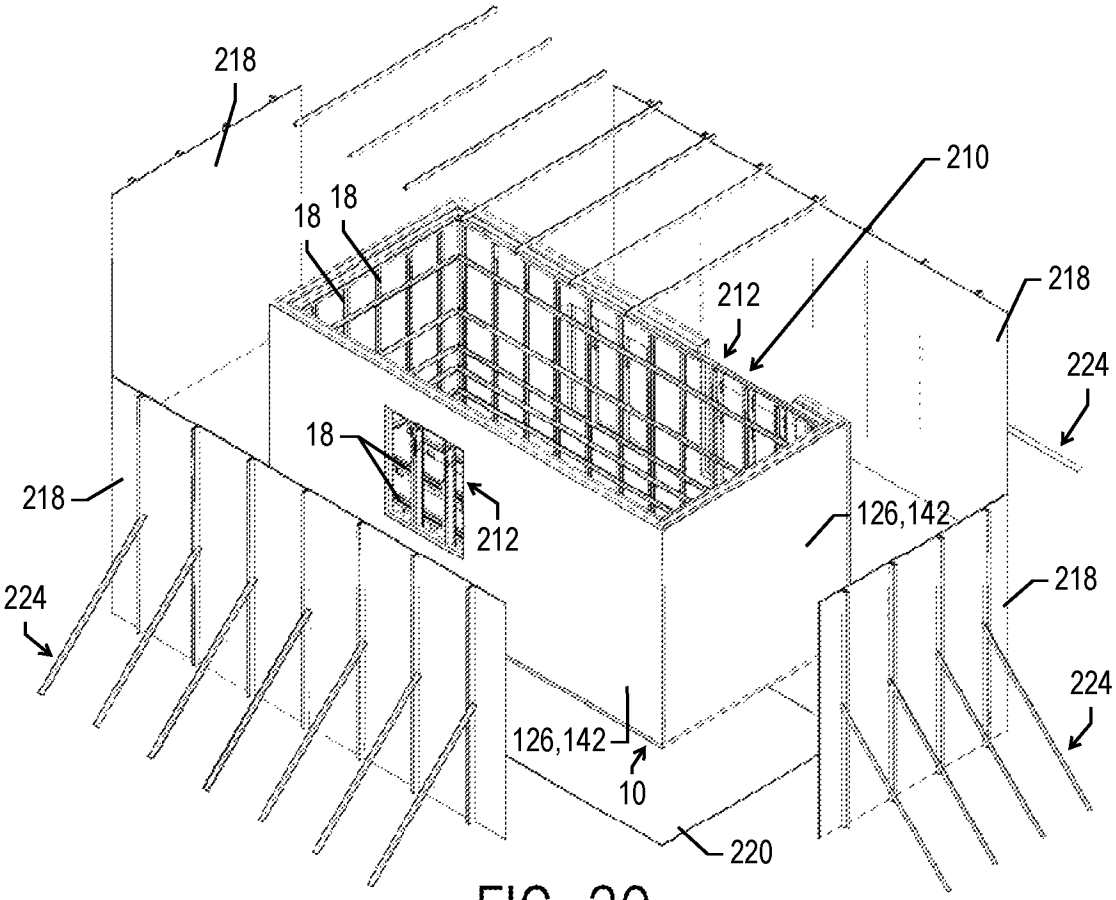
Figure 21:
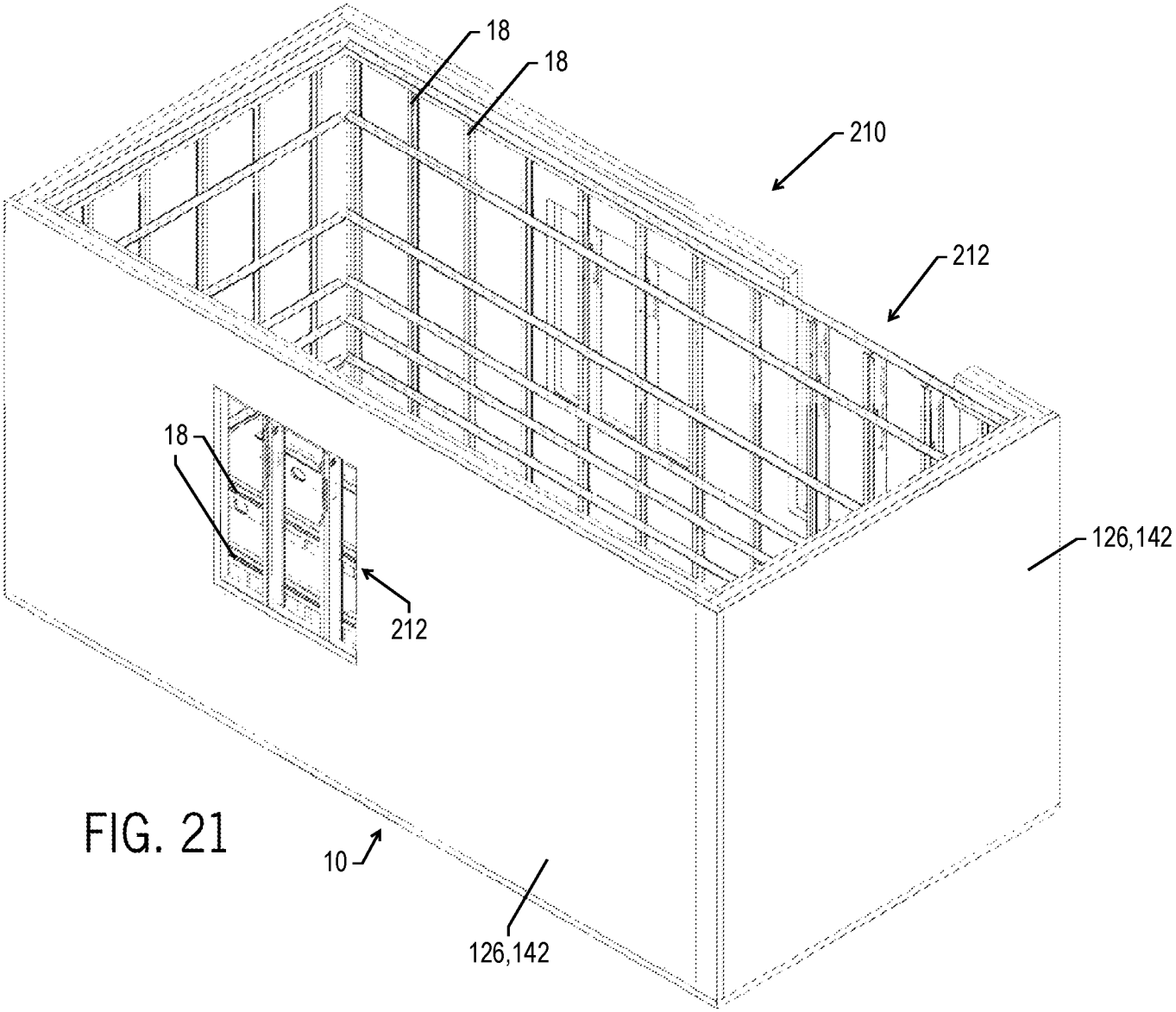
Figure 22:
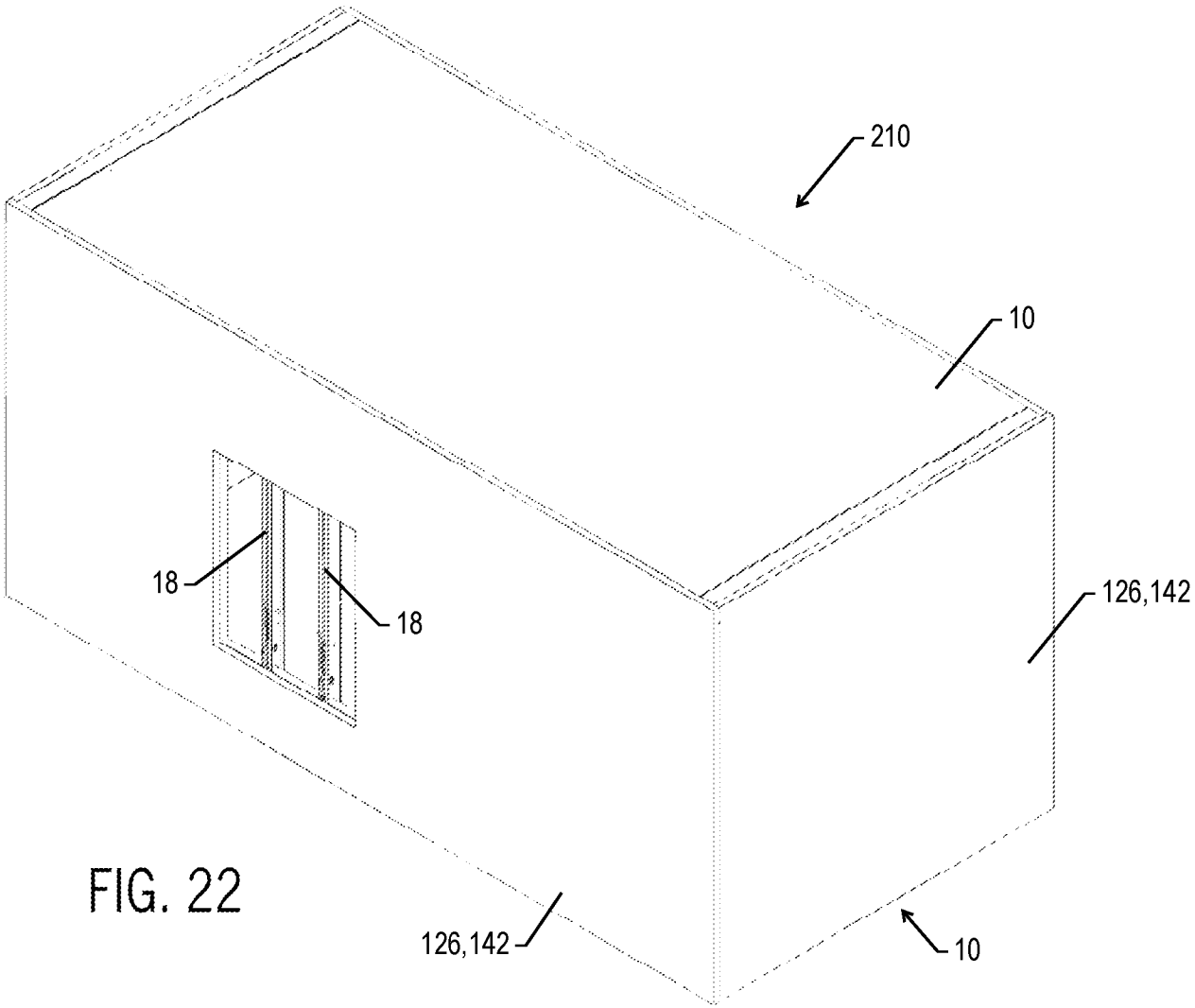

Referring now to FIGS. 16-18, FIGS. 16 and 17 show exploded perspective and perspective views, respectively, of a construction panel module 200 constructed with variations of construction panels 10, 126, 142 of FIGS. 1 and 2, 12 and 13, and 14 and 15, respectively, according to an embodiments of the invention, and FIG. 18 shows a detailed view of a connection 202 between construction panels 10, 126, 142 in FIG. 17, according to an embodiment of the invention. Each connector 202 is mounted within a well 204 across construction panels 10, 126, 142 and includes a plurality of connection bars 206 and a plurality of fasteners 208 extending through connection bars 206 and into constructions panels 10, 136, 142.

FIGS. 19-22 show perspective views of a technique for manufacturing a single pour construction panel module 210 using framing members 18 of FIGS. 3-9 and included in construction panels 10, 126, 142 of FIGS. 1 and 2, 12 and 13, and 14 and 15, respectively, according to an embodiment of the invention. The technique proceeds as follows:

The floor joists 18 are turned upside down with bent FRP bars sticking out of the joists 18 downward and they will be used to hold the horizontal and vertical reinforcement bars in the later steps.

The wall studs 18 along the FRP bent bars 46, 48 will be connected to floor joists 18 on either side by positioning them vertically.

The window and door blockouts 212 will be framed in between the wall studs 18 as needed in the vertical position, where the studs 18 will hold the blockouts 212 in the right position with simple cold-formed steel angle clip connectors.

Then the ¼-inch insulation will be installed to the wall studs 18 that are vertically positioned. Then the horizontal and vertical reinforcement will be tied to the FRP bent bars 46, 48 of wall studs 18 to hold them in place as needed.

The top of the studs 18 will be temporarily stabilized using bracing to keep the studs 18 in vertical position until the setup is placed in the mold 214. Then the 3-inch insulation layer 16 will be connected between the wall studs 18. This insulation layer 16 will have a radiant barrier with tensile capacity on the outer side (the tension side). This 3-inch insulation layer 16 will be temporarily braced with cold-formed steel angles connected to wall studs 18. These temporary bracings are required to take tension pressure from concrete when the wall studs 18 are in vertical position. The tension pressures are mainly high at the bottom third of the wall in the vertical position. After the concrete is cured those cold-formed steel temporary angle braces will be removed and reused for the next module.

Then the embeds that go into the concrete can be tied to the metal studs 18 in the right locations. Typically these embeds are very small and typical to connect to hold them in place. All the other blockouts 212 will be blocked using the cold-formed steel angle steel parts and 3-inch insulation layer 16.

This skeleton 216 will be assembled outside of the mold 214 or it could be assembled right on the mold 214 when the side plates 218 of the mold 214 are removed.

Assuming the skeleton 216 is assembled outside of the mold 214 by a crew, the other crew prep the mold 214 ready for the pour by cleaning the bottom and side plates 220, 218 of the mold 214 and spraying the release agents on all side and bottom plates 218, 220.

Based on the size of the module 210, the mold side plates 218 are connected and secured. The mold plates 218, 220 can be connected either before or after the skeleton 216 is placed in the mold 214.

Case 1: Assume that the module 210 has 4 sides, which means that the module 210 will have both load bearing and non-load bearing walls 126, 142. Now the easiest way is to connect the mold plates 218, 220 and then bring in the skeleton 216 gently from the top and hold it in the air 2½ inches above the bottom of the mold 210 (2½ inches is the gap between the floor joist flange and the bottom of the mold). Now, connect the top of wall studs 18 to the horizontal temporary braces at the top of the mold to bolt the skeleton 216 setup in place by hanging 2½ inches above the bottom of the mold 210.

If needed, one or two crew members can get into the mold 210 setup to inspect all the parts that are secured and in place before the concrete pour takes place. Mostly this step will be avoided and the inspection is done prior to placing the skeleton 216 in the mold 210.

After the skeleton 216 is placed, all the mold joints 222 are checked and blockouts 212 are inspected and then the outside temporary bracing 224 are connected to the mold plates 218, 220 (these braces 224 may not be needed since the mold 214 is connected at the top but in case it is needed, they will be added) and the mold 214 is now ready for concrete pour. The concrete gets poured from the top of the mold 214 and due to gravity it gets into all the gaps. The concrete is self-consolidated concrete and it will seep through any gap and it requires very less vibration for curing or in some cases no vibration is needed. All the necessary steps to make sure the concrete curing is done will be properly applied. In the floor area 10, the self-consolidation concrete will seep into all the areas without issues and, in case of mold 214, vibrations are required, which can be done to make the concrete fill up in all gaps.

After the curing is done, the bolts to the mold plates 218, 220 will be loosened and the module 210 will be stripped by lifting it up. The module 210 will be rotated 180 degrees after it is lifted up from the mold 214.

In this case, the non-load bearing walls 126, 142 will be carried by the load-bearing walls 126, 142. Basically the load-bearing walls 126, 142 will carry the weights of floor 10 and non-load bearing walls 126, 142. That is the load path.

Case 2: The module 210 only includes the load bearing walls 126, 142. There will be no side plates of the mold 210 on the non-load bearing side. The skeleton 216 will be placed and all the remaining steps will be the same as for Case 1.

Figure 23:
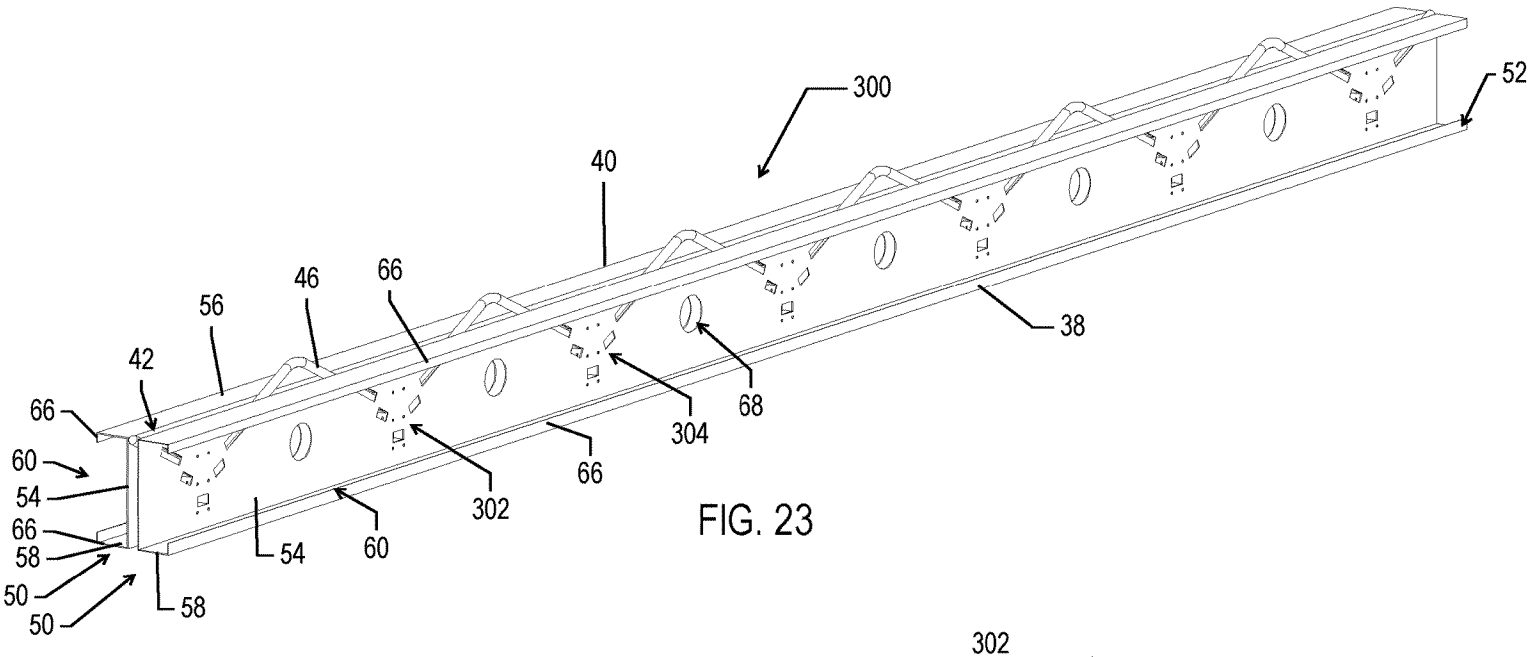
FIG. 23 is a bottom perspective views of a framing member, according to another embodiment of the invention.

Referring now to FIG. 23, a bottom perspective view of a framing member 300 is shown, according to another embodiment of the invention. Framing member 300 is arranged similarly to framing member 18 in FIG. 3 and, thus, like elements are numbered identically to corresponding elements in framing member 18. In general, the arrangement of framing member 300 is identical to framing member 18 in many aspects. Therefore, the description of framing member 18 above is entirely applicable to framing member 300 with the exception of where framing member 300 differs from framing member 18.

Framing member 300 differs from framing member 18 in that framing member 300 does not include any channel connectors 44. Instead, webs 54 of channels 38, 40 of framing member 300 include a plurality of bendable punch tabs 302 for the placement of one or more bent bars, such as, for example, bent bar 46 shown in FIG. 23, within gap 42 between channels 38, 40 and a plurality of fastener openings 303 through which a plurality of fasteners 304 extend to couple channels 38, 40 together. The use of bendable punch tabs 302 in framing member 300 makes the assembly of framing member 300 quicker than the assembly of framing member 18. Further, since channel connectors 44 are not needed, framing member 300 is also more cost-effective than framing member 18.

Figure 24:
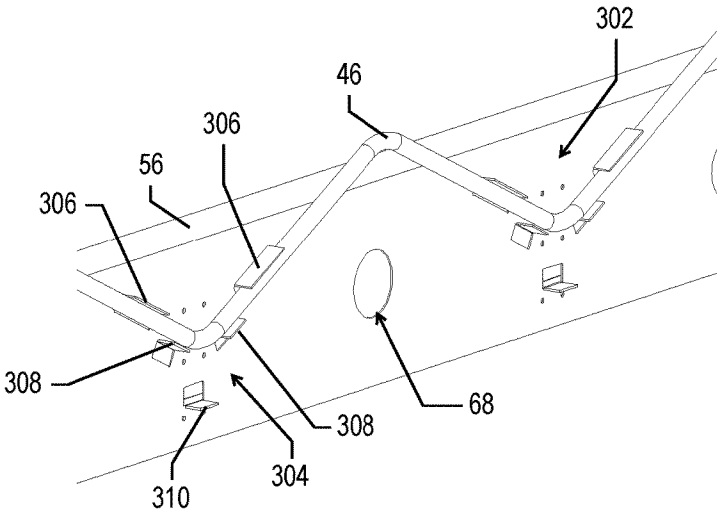
FIG. 24 is a bottom perspective view of a section of the framing member of FIG. 23 with one channel removed, according to an embodiment of the invention.

Referring now to FIG. 24, a bottom perspective view of a section 305 of framing member 300 is shown with first channel 38 removed, according to another embodiment of the invention. Section 305 of framing member 300 in FIG. 24 shows the arrangement of punch tabs 302 in second channel 40 and the arrangement of bent bar 46 with respect to punch tabs 302 more clearly. While not shown in FIG. 24, first channel 38 includes the same arrangement of punch tabs 302 as second channel 40 except that punch tabs 302 of first channel 38 is positioned slightly lower than punch tabs 302 in second channel 40 such that punch tabs 302 of channels 38, 40 do not occupy the same space in gap 42.

Punch tabs 302 are arranged with a V-shape and include lower punch tabs 306, central punch tabs 308, and an upper punch tab 308. Lower and central punch tabs 306, 308 bend down toward bottom flange 56 of second channel 40. Upper punch tab 310 bends upward toward top flange 58. Bent bar 46 is positioned between lower and central punch tabs 306, 308 so that bent bar 46 is in the appropriate position in gap 42. Punch tabs 302 are generally formed during manufacturing and then bent to their appropriate positions during assembly and/or installation.

Figure 25:
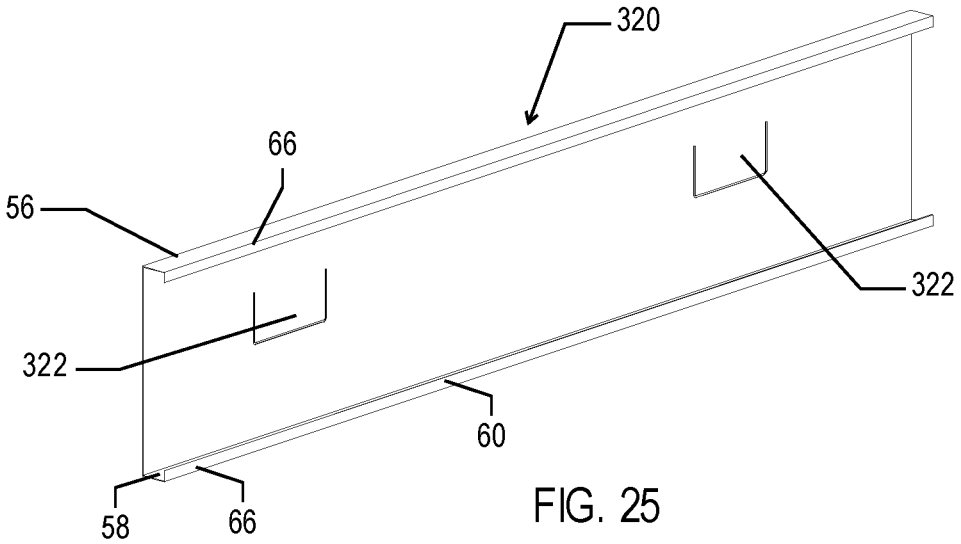
FIGS. 25 and 26 are bottom perspective views of a channel section including bendable punch tabs for insulation, according to another embodiment of the invention.
Figure 26:
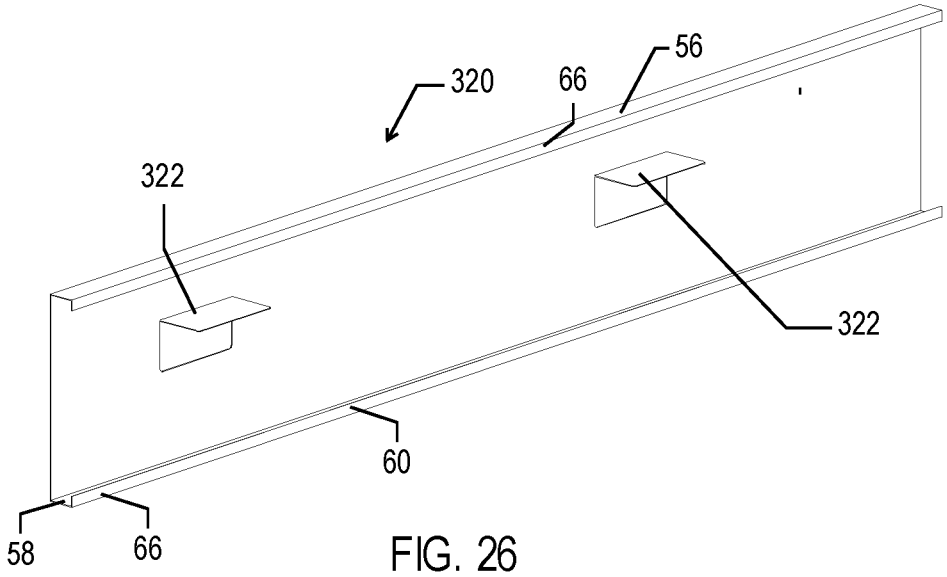

Referring now to FIGS. 25 and 26, bottom perspective views of a channel section 320 including bendable punch tabs 322 for an insulation layer are shown, according to another embodiment of the invention. Channel section 320 is arranged for use in channels 38, 40 of framing members 18, 300 in FIGS. 3, 23 and, thus, like elements in channel section 320 are numbered identically to corresponding elements in framing members 18, 300. Punch tabs 322 in channel section 320 are provided for use with an insulation layer such as, for example, insulation layer 16 shown in FIG. 1. Punch tabs 322 bend downward toward bottom flange 56 on the same side as opening 60 created between flanges 56, 58. Punch tabs 322 are generally formed during manufacturing and then bent to their appropriate positions during assembly and/or installation. Punch tabs 322 are typically used with a cast-in-place (CIP) method associated with construction panels 10, 126, 142 of FIGS. 1 and 2, FIGS. 12 and 13, FIGS. 14 and 15, respectively. During the CIP method, punch tabs 322 support an insulation layer, such as, for example, insulation layer 16, during casting. As an alternative or in addition to punch tabs 322, Z-purlins (not shown) may be attached to bottom flange 56 to support the insulation layer.

The CIP method may be described as follows: The first step is to assemble framing members 18, 300. The next step is to screw or tack weld joist hangers to ends 50, 52 of framing members 18, 300, if necessary. The following step is to erect/install assembled framing members 18, 300 on newly poured or erected walls. Thereafter, punch tabs 322 are bent into place and/or Z-purlins are used to support rigid insulation, such as, for example, insulation layer 16, for supporting construction loads. Thereafter, rebar 28 is placed for transverse or longitudinal reinforcement, as needed, on top of framing members 18, 300. The next steps is put cross bracings to framing members 18, 300 in place for a complete floor system. All gaps in the insulation should be filled with spray rigid foam insulation. Finally, concrete is poured in place as a single monolithic pour. In general, during any method of creating a construction panel with framing members 18, 300, concrete may be poured face up or face down. However, face-up pouring is often more cost effective and feasible than face-down pouring.

Figure 27:
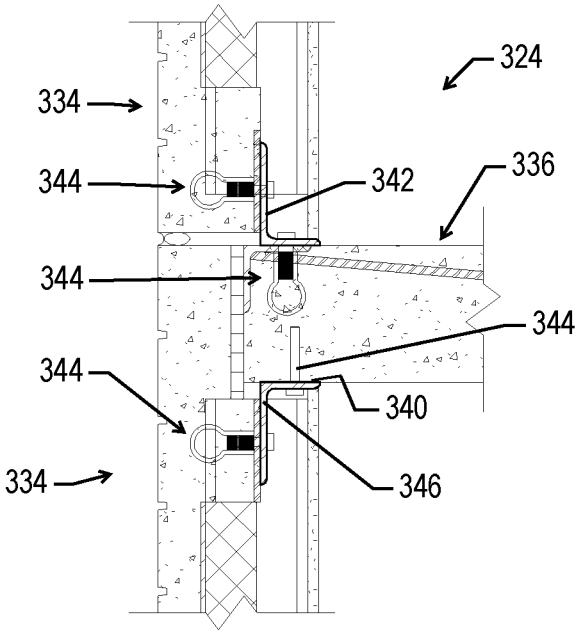
FIGS. 27-34 are views of connections for use with the construction panels of FIGS. 1 and 2, FIGS. 12 and 13, and FIGS. 14 and 15, according to embodiments of the invention.
Figure 28:
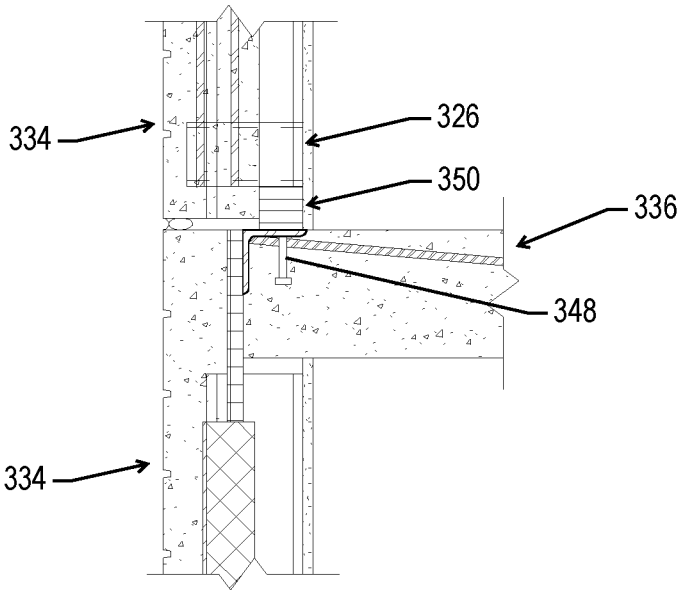
Figure 29:
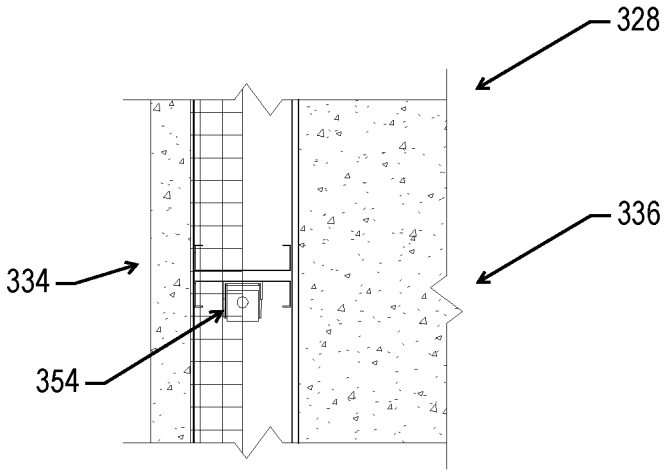
Figure 30:
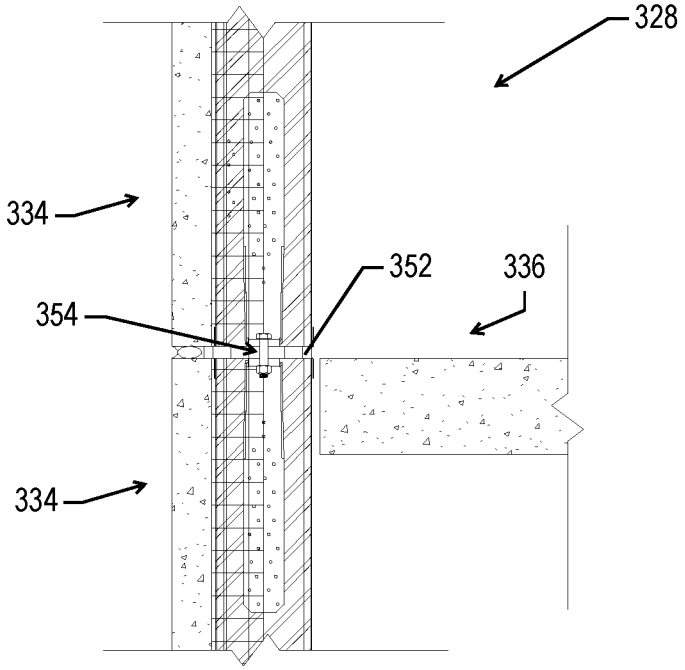
Figure 31:
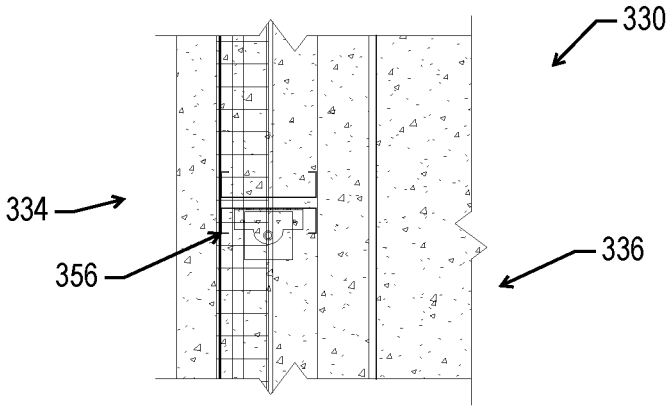
Figure 32:
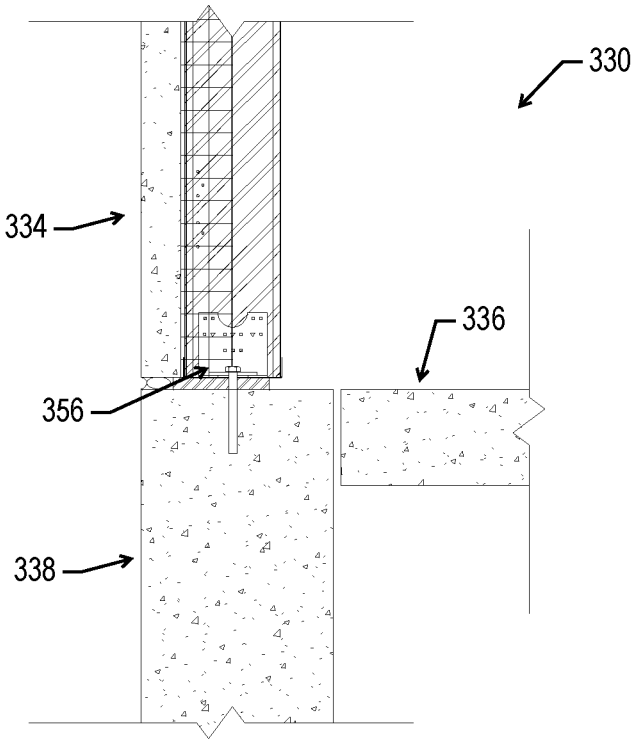
Figure 33:
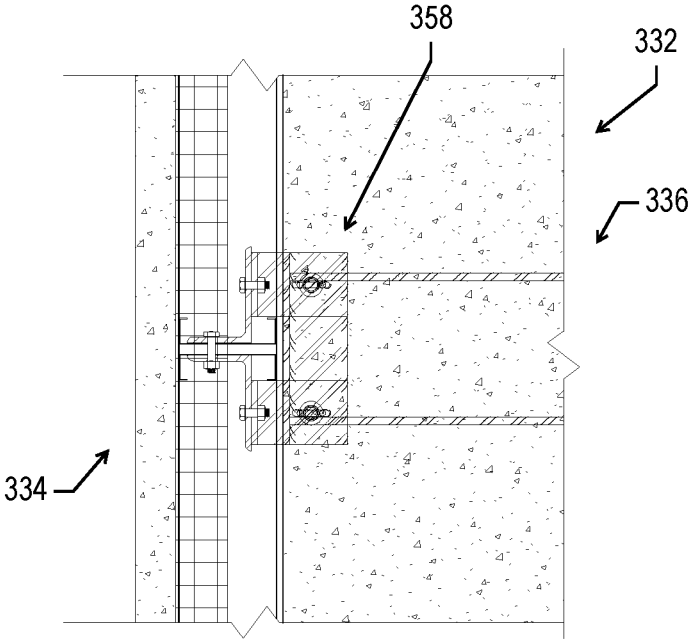
Figure 34:
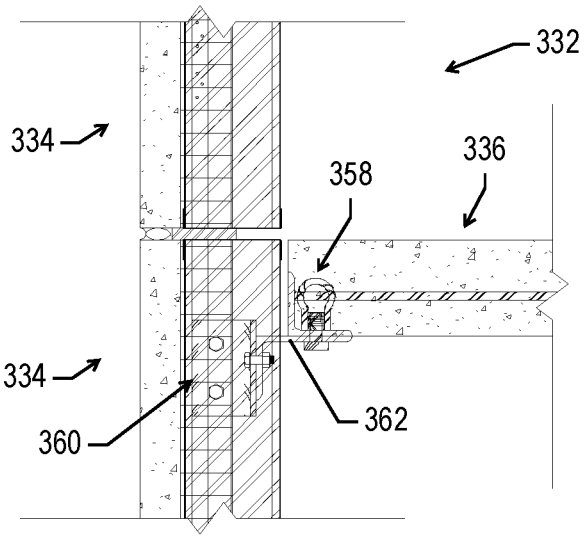

Referring now to FIGS. 27-34, views of connections 324, 326, 328, 330, 332 for use with the construction panels 340 representing any of construction panels 10, 126, 142 of FIGS. 1 and 2, FIGS. 12 and 13, and FIGS. 14 and 15, respectively, are shown, according to embodiments of the invention. FIG. 27 is a side view of a slab edge connection 324 between two construction panels 334 and a concrete slab 336. FIG. 28 is a side view of a panel bridge connection 326 between two construction panels 334 and concrete slab 336, according to an embodiment of the invention. FIGS. 29 and 30 are top and side views of a tie down connection 328 between two construction panels 334 adjacent concrete slab 336. FIGS. 31 and 32 are top and side views of a base connection 330 between concrete panel 334, concrete slab 336, and a concrete wall 338. FIGS. 33 and 34 are top and side views of a slab bridge connection 332 between concrete panels 334 and concrete slab 336. The embodiments shown in FIGS. 27-34 share many similar elements and therefore will be described together with like elements being used for each connection 324, 326, 328, 330, 332.

Referring initially to FIG. 27, in connection 324, top and bottom construction panels 334 are joined with concrete slab 336. Slab 336 is positioned on an inset 340 in bottom panel 334. Top and bottom angle brackets 342 couple panels 334 via ferrule inserts 344 in panels 334 and slab 336 and a bolt 346 in slab 336. Referring now to FIG. 28, in connection 326, top and bottom panels 334 are joined with slab 336. Slab 336 is a post-tensioned slab and is positioned on inset 340 of bottom panel 334. Slab 336 is joined with a bolt 350 extending into a shim stack 350 in above slab 336.

Referring now to FIGS. 29 and 30, in connection 328, top and bottom panels 334 are joined adjacent slab 336. An insulation layer 352 is positioned between panels 334, which are joined via a bolt connection 354. Referring now to FIGS. 31 and 32, in connection 330, one panel 334 is joined with concrete wall 338 via a bolt connection 356 adjacent to slab 336. Referring now to FIGS. 33 and 34, in connection 332, top and bottom panels 334 are joined with slab 336. Top panel 334 is stacked on bottom panel 334 in line with bottom panel 334. Slab 336 is joined to bottom panel 334 via a ferrule insert and tail bar system 358 in slab 336 and a bolt connection 360 in bottom panel 334 coupled to an angle bracket 362 therebetween.

Beneficially embodiments of the invention thus provide a framing member, a construction panel incorporating the framing member, and methods of manufacturing the framing member and construction panel. The framing member includes first and second channels with a gap therebetween to create an internal area, a plurality of extending between the first and second channels within the gap, and at least one bent bar positioned within the gap adjacent the channel connectors. The plurality of flanges may be in the form of a plurality of punch tabs or included in a plurality of channel connectors. Each bent bar includes a plurality of bar sections extending from internal bends within the internal area between the first and second channels to external bends in an external area beyond the first and second channels.

The construction panel incorporates the above-referenced framing member therein. The construction panel includes a concrete layer and a plurality of the framing members coupled to the concrete layer via the bar sections and externals bends extending into the concrete layer. The material of the bent bar is generally selected to reduce the heat transfer between the concrete layer and the first and second channels of the framing members. A first insulation layer may be positioned between the framing members and the concrete layer to create a thermal break between the concrete layer and the first and second channels of the framing members. The thermal break eliminates at least 90% of the thermal bridging between the first and second channels of the framing members and the concrete layer. A second insulation layer may be positioned over the first insulation layer to increase the thermal efficiency of the construction panel.

The method of manufacturing the construction panel includes pouring a concrete layer. The concrete layer may be poured over a rebar grid. The above-referenced framing members may be assembled for coupling to the concrete layer during the concrete pour. Once the concrete pour is complete, a first insulation may be applied on the concrete layer and the framing members may be coupled to the concrete layer through the first insulation layer, when present. Thereafter, a second insulation layer may be applied over the first insulation layer and/or concrete layer and against the framing members. The first and second insulation layers may then be coupled to the concrete layer via connectors extending through the first and second insulation layers and into the concrete layer. Other structural components may also be added with the second insulation layer. In that case, the concrete pour may need to be continued such that the concrete layer achieves an appropriate thickness. Once the concrete layer has cured, the framing members and insulation layers will be coupled to the concrete layer, and the construction panel is ready for installation.

The construction panel may be used in a variety of different locations for floor or wall panels in a variety of different structures. As non-limiting examples, the construction panel may be used in residential or commercial building structures as below grade foundation walls or basement walls; in low-rise multi-family residential, hospitality, commercial, institutional, or industrial buildings; and in mid-rise and high-rise buildings as primary load and non-load bearing structures or as curtain walls. The design of the construction panel can reduce construction time up to 40%, cost up to 25%, the weight of concrete in the panel up to 50%, and the weight of the overall panel up to 40% while maintaining structural integrity and allowing for the ability to apply over 100 finishes to the panel. The weight reduction of the construction panel will allow for the use of a smaller crane to position the panels and for a foundation designed for a lighter load, which both provide an additional cost reduction for the overall construction of a building. Additionally, the framing members for the construction panel may be made with 95% recycled steel and with non-toxic materials.

Further, the construction panel design is waterproof and can include the features of a conventional construction panel for connecting to other framing components or for lifting of the construction panel by a crane. The design also allows any type or size of opening to be used therein without the need to cut the framing members and have enough block-out for poured concrete. No patch work is needed for the block-out to avoid concrete seepage. The block-out can be a continuous blockage for concrete to form any shape needed.

In addition, the construction panel design can increase open space in the panel by at least 30% to provide additional insulation that would aid in achieving a Net Zero Energy building. The extra open space in the construction panel will allow for placement of insulation at heavy-duty connection locations and in jambs for bigger window and door openings in wall panels for a continuous path of insulation. The design further incorporates a lower depth to span ratio than conventional construction panels to provide more headroom or less building height, which is ideal for adding floors into existing spaces or high-rise building projects.

The construction panel may have a built-in R-value of at least 20 when used as a floor panel and at least 24 when used as a wall panel, with potential for R-values of 40 and above. Also, the configuration and positioning of the framing members in the construction panel allow for the elimination of tracks to support wall or floor panels above the construction panel. In addition, the construction panel does not require furring for drywall installation. Moreover, when included, the use of rigid foam board insulation provides more sound attenuation than wood framing.

The method of manufacturing the construction panel is an improved method for making precast construction panels. Initially, the method may be performed in a temperature-controlled facility off site and shipped on site for erection, which saves on the limited space available on site and increases dependability since it is not dependent on the weather. The method also provides a quicker way to make precast construction panels. The method only requires one pour of concrete and allows for concrete to be poured at its full thickness in case it is necessary to support external framing members such as, for example, heavy structural steel beams or joist girders. Also, the manufacturer or builder is able to work on assembling the framing members at the same time as the concrete pour and still embed the framing members into the formed concrete layer prior to curing of the concrete layer. Furthermore, the method allows for, but does not require, the installation of steel tracks to support walls or floors above the construction panel.

The method also allows for wide variability in design. Any type or size of opening, such as, for example, a wall or door opening, may be included via the use of a block-out. The framing members may be placed according to any spacing based on structural and architectural requirements for the construction panel and may be positioned across window or door block-outs without the need to cut the framing members. Moreover, any type and size of steel embed may be included for connecting other structural elements in a manner similar to that of traditional precast construction panels without compromising on the level of complexity in installing embeds.

Therefore, according to one embodiment of the invention, a framing member for construction panels includes first and second channels. The first channel includes a web and first and second flanges extending from the web in a first direction to form an opening. The second channel includes a web spaced apart from the web of the first channel to form an internal area between the webs of the first and second channels and first and second flanges extending from the web in a second direction to form an opening facing away from the opening in the first channel. The framing member also includes a plurality of flanges positioned in and extending across the internal area. In addition, the framing member includes a first bent bar having a first plurality of bar sections, each bar section of the first plurality of bar sections extending from within the internal area to an external area beyond the first flanges of the first and second channels and positioned adjacent to at least one flange of the plurality of flanges in the internal area. Further, the framing member includes a plurality of fasteners coupling the first channel to the second channel.

According to another embodiment of the present invention, a construction panel includes a concrete layer and a plurality of framing members coupled to the concrete layer. Each framing member of the plurality of framing members includes a first channel and a second channel. The first channel includes a web and first and second flanges extending from the web in a first direction to form an opening. The second channel includes a web spaced apart from the web of the first channel to form a gap between the webs of the first and second channels and first and second flanges extending from the web in a second direction to form an opening facing away from the opening in the first channel. Each framing member additionally includes a plurality of flanges positioned in and extending across the gap. Each framing member further includes first bent bar having a first plurality of bar sections, each bar section of the first plurality of bar sections positioned adjacent to at least one flange of the plurality of flanges in the gap and extending out from within the gap and into the concrete layer. In addition, the first bent bar includes a first plurality of bends positioned within the gap and connecting adjacent bar sections of the first plurality of bar sections and a second plurality of bends positioned in the concrete layer and coupling adjacent bar sections of the first plurality of bar sections. Furthermore, each framing member includes a plurality of fasteners coupling the first channel to the second channel.

According to yet another embodiment of the present invention, a method of manufacturing a construction panel includes providing or assembling a plurality of framing members. Each framing member includes first and second channels. The first channel includes a web and first and second flanges extending from the web in a first direction to form an opening. The second channel includes a web spaced apart from the web of the first channel to form a gap between the webs of the first and second channels and first and second flanges extending from the web in a second direction to form an opening facing away from the opening in the first channel. Each framing member additionally includes a plurality of flanges positioned in and extending across the gap. Furthermore, each framing member includes a bent bar with a plurality of bar sections, each bar section of the plurality of bar sections positioned adjacent to at least one flange of the plurality of flanges in the gap and extending from respective positions inside the gap to respective positions outside the gap beyond the first flanges of the first and second channels. The bent bar also includes a first plurality of bends positioned within the gap and connecting adjacent bar sections of the plurality of bar sections and a second plurality of bends positioned outside of the gap beyond the first flanges of the first and second channels and coupling adjacent bar sections of the plurality of bar sections. Each framing member further includes a plurality of fasteners coupling the first channel to the second channel. The method further includes pouring a concrete layer and coupling each framing member of the plurality of framing members to the concrete layer by inserting into the concrete layer each bend of the second plurality of bends of the bent bar and at least a portion of each bar section of the plurality of bar sections of the bent bar partially extending outside of the gap and allowing the concrete layer to cure.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A framing member for construction panels, the framing member comprising:

a first channel having:

a web; and first and second flanges extending from the web in a first direction to form an opening;

a second channel having:

a web spaced apart from the web of the first channel to form an internal area between the webs of the first and second channels; and first and second flanges extending from the web in a second direction to form an opening facing away from the opening in the first channel;

a plurality of flanges positioned in and extending across the internal area;

a first bent bar having a first plurality of bar sections, each bar section of the first plurality of bar sections:

extending from within the internal area to an external area beyond the first flanges of the first and second channels; and positioned adjacent to at least one flange of the plurality of flanges in the internal area;

a plurality of fasteners coupling the first channel to the second channel; and a plurality of channel connectors each having at least one bent plate coupling the first channel to the second channel via the plurality of fasteners;

wherein:

each flange of the plurality of flanges is integrally formed with the at least one bent plate of one channel connector of the plurality of channel connectors; and each bar section of the first plurality of bar sections is positioned adjacent to one channel connector of the plurality of channel connectors.

2. The framing member of claim 1 wherein the plurality of fasteners extend through the web of the first channel, across the internal area, and through the web of the second channel.

3. A framing member for construction panels, the framing member comprising:

a first channel comprising:

a web; and first and second flanges extending from the web in a first direction to form an opening;

a second channel comprising:

a web spaced apart from the web of the first channel to form an internal area between the webs of the first and second channels; and first and second flanges extending from the web in a second direction to form an opening facing away from the opening in the first channel;

a plurality of flanges positioned in and extending across the internal area;

a first bent bar comprising a first plurality of bar sections, each bar section of the first plurality of bar sections:

extending from within the internal area to an external area beyond the first flanges of the first and second channels; and positioned adjacent to at least one flange of the plurality of flanges in the internal area;

a plurality of fasteners coupling the first channel to the second channel and extending through the web of the first channel, across the internal area, and through the web of the second channel.

4. The framing member of claim 3 further comprising a second bent bar comprising a plurality of bar sections, each bar section of the plurality of bar sections of the second bent bar extending from the interior area to the exterior area and positioned adjacent to at least one flange of the plurality of flanges.

5. The framing member of claim 3 wherein the first bent bar further comprises:

a plurality of internal bends connecting adjacent bar sections of the first plurality bar sections in the internal area; and at least one external bend coupling adjacent bar sections of the first plurality of bar sections in the external area.

6. The framing member of claim 3 wherein the first bent bar comprises a second plurality of bar sections, each bar section of the second plurality of bar sections extending from one internal bend of the plurality of internal bends toward the second flanges of the first and second channels.

7. The framing member of claim 3 wherein each flange of the plurality of flanges is formed integrally with the web of the first channel or the web of the second channel.

8. The framing member of claim 7 wherein each flange of the plurality of flanges is a bendable punch tab.

9. The framing member of claim 3 further comprising a plurality of channel connectors each comprising at least one bent coupling the first channel to the second channel via the plurality of fasteners;

wherein each flange of the plurality of flanges is integrally formed with the at least one bent plate of one channel connector of the plurality of channel connectors;

wherein each bar section of the first plurality of bar sections is positioned adjacent to one channel connector of the plurality of channel connectors; and wherein the at least one bent plate of each channel connector comprises:

a first bent plate comprising:

a web positioned in the internal area adjacent to the web of the first channel and comprising first and second parallel edges;

a first flange extending from the first parallel edge of the web across the first flange of the first channel; and a second flange forming one flange of the plurality of flanges and extending from the second parallel edge of the web toward the web of the second channel; and a second bent plate comprising:

a web positioned in the internal area adjacent to the web of the second channel and comprising first and second parallel edges;

a first flange extending from the first parallel edge of the web of the second bent plate across the first flange of the second channel; and a second flange forming one flange of the plurality of flanges and extending from the second parallel edge of the web of the second bent plate toward the web of the first channel and across the second flange of the first bent plate.

10. The framing member of claim 9 wherein:

the first parallel edges of the webs of the first and second bent plates of each channel connector are longer than the second parallel edges;

the webs of the first and second bent plates of each channel connector comprise first and second angled edges connecting the first and second parallel edges;

the first and second angled edges of the first and second bent plates of each channel connector comprise respective first and second angled flanges extending therefrom and forming flanges of the plurality of flanges; and each bar section of the first plurality of bar sections is positioned adjacent either the first angled flanges or the second angled flanges of the first and second bent plates of one channel connector of the plurality of channel connectors.

11. The framing member of claim 10 wherein an angle formed between the first and second angled flanges of the first and second bent plates of each channel connector matches an angle formed between adjacent bar sections of the first plurality of bar sections of the first bent bar.

12. The framing member of claim 9 wherein the plurality of fasteners couples the first channel to the second channel by coupling:

the first flange of the first bent plate of each channel connector to the first flange of the first channel;

the first flange of the second bent plate of each channel connector to the first flange of the second channel; and the second flange of the first bent plate to the second flange of the second bent plate in each channel connector.

13. The framing member of claim 12 wherein the plurality of fasteners couples the first channel to the second channel by coupling:

the web of the first bent plate of each channel connector to the web of the first channel; and the web of the second bent plate of each channel connector to the web of the second channel.

14. A construction panel comprising:

a concrete layer; and a plurality of framing members coupled to the concrete layer, each framing member of the plurality of framing members comprising:

a first channel comprising:

a web; and first and second flanges extending from the web in a first direction to form an opening;

a second channel comprising:

a web spaced apart from the web of the first channel to form a gap between the webs of the first and second channels; and first and second flanges extending from the web in a second direction to form an opening facing away from the opening in the first channel;

a plurality of flanges positioned in and extending across the gap;

a first bent bar comprising:

a first plurality of bar sections, each bar section of the first plurality of bar sections:

positioned adjacent to at least one flange of the plurality of flanges in the gap; and extending out from within the gap and into the concrete layer;

a first plurality of bends positioned within the gap and connecting adjacent bar sections of the first plurality of bar sections; and a second plurality of bends positioned in the concrete layer and coupling adjacent bar sections of the first plurality of bar sections;

a plurality of fasteners coupling the first channel to the second channel; and an insulation layer positioned between the concrete layer and the first and second channels of each framing member of the plurality of framing members.

15. The construction panel of claim 14 wherein the plurality of flanges of each framing member of the plurality of framing members are either:

integrally formed with the webs of the first and second channels as a plurality of bendable punch tabs; or integrally formed with a plurality of channel connectors, each channel connector comprising at least one bent plate that couples the first channel to the second channel via the plurality of fasteners and that comprises at least one flange of the plurality of flanges.

16. The construction panel of claim 14 further comprising a second bent bar comprising:

a plurality of bar sections, each bar section of the plurality of bar sections extending out from within the gap and into the concrete layer;

a first plurality of bends positioned within the gap and connecting adjacent bar sections of the plurality of bar sections; and a second plurality of bends positioned in the concrete layer and coupling adjacent bar sections of the plurality of bar sections.

17. The construction panel of claim 14 wherein the insulation layer is a first insulation layer, and further comprising a second insulation layer positioned over the first insulation layer and into the openings of the first and second channels of each framing member of the plurality of framing members.

18. The construction panel of claim 14 wherein each bar section of the first plurality of bar sections of the first bent bar of each framing member extends into at least half of a thickness of the concrete layer.

19. The construction panel of claim 14 wherein:

the concrete layer includes a plurality of reinforcing bars therein; and at least one reinforcing bar extends through the concrete layer between the first and second channels and at least one bend of the second plurality of bends.

20. The construction panel of claim 14 wherein the first bent bar of each framing member comprises a second plurality of bar sections each extending from one bend of the first plurality of bends toward the second flanges of the first and second channels.

21. A method of manufacturing the construction panel of claim 14, the method comprising:

providing or assembling the plurality of framing members;

pouring the concrete layer; and coupling each framing member of the plurality of framing members to the concrete layer by:

inserting into the concrete layer each bend of the second plurality of bends of the bent bar and at least a portion of each bar section of the plurality of bar sections of the bent bar partially extending outside of the gap; and allowing the concrete layer to cure.

22. A method of manufacturing a construction panel, the method comprising:

providing or assembling a plurality of framing members, each framing member of the plurality of framing members comprising:

a first channel comprising:

a web; and first and second flanges extending from the web in a first direction to form an opening;

a second channel comprising:

a web spaced apart from the web of the first channel to form a gap between the webs of the first and second channels; and first and second flanges extending from the web in a second direction to form an opening facing away from the opening in the first channel;

a plurality of flanges positioned in and extending across the gap;

a bent bar comprising:

a plurality of bar sections, each bar section of the plurality of bar sections:

positioned adjacent to at least one flange of the plurality of flanges in the gap; and extending from respective positions inside the gap to respective positions outside the gap beyond the first flanges of the first and second channels;

a first plurality of bends positioned within the gap and connecting adjacent bar sections of the plurality of bar sections; and a second plurality of bends positioned outside of the gap beyond the first flanges of the first and second channels and coupling adjacent bar sections of the plurality of bar sections; and a plurality of fasteners coupling the first channel to the second channel;

pouring a concrete layer; and coupling each framing member of the plurality of framing members to the concrete layer by:

inserting into the concrete layer each bend of the second plurality of bends of the bent bar and at least a portion of each bar section of the plurality of bar sections of the bent bar partially extending outside of the gap;

positioning a first layer of insulation on the concrete layer such that, when the concrete layer is cured, each framing member of the plurality of framing members is coupled to the concrete layer through the insulation layer; and allowing the concrete layer to cure.

23. The method of claim 22 further comprising positioning a second layer of insulation over the first layer of insulation and into the openings of the first and second channels of each framing member of the plurality of framing members.

24. The method of claim 22 further comprising, prior to coupling each framing member of the plurality of framing members to the concrete layer, positioning at least one reinforcing bar between each bend of the second plurality of bends of the bent bar and the first flanges of the first and second channels.

25. The method of claim 22 wherein:

providing or assembling the plurality of framing members comprises assembling each framing member of the plurality of framing members; and assembling each framing member of the plurality of framing members comprises:

positioning a plurality of channel connectors within the gap, each channel connector of the plurality of channel connectors comprising at least one bent plate positioned within the gap and comprising at least one flange of the plurality of flanges;

positioning the bent bar between the webs of the first and second channels such that the first plurality of bends are positioned within the gap, the second plurality of bends are positioned outside of the gap beyond the first flanges of the first and second channels, and each bar section of the plurality of bar sections is positioned adjacent to one channel connector of the plurality of channel connectors; and coupling the first channel to the second channel with the plurality of channel connectors via the plurality of fasteners.

26. The method of claim 21 wherein:

providing or assembling the plurality of framing members comprises assembling each framing member of the plurality of framing members; and assembling each framing member of the plurality of framing members comprises:

positioning the plurality of flanges in the internal area by adjusting a plurality of bendable punch tabs in the webs of first and second channels;

positioning the bent bar between the webs of the first and second channels such that the bent bar is bound by the plurality of flanges; and coupling the first channel to the second channel via the plurality of fasteners.

* * * * *